US005538838A

United States Patent [19]

Suga et al.

[11] Patent Number: 5,538,838

[45] Date of Patent: Jul. 23, 1996

[54] SILVER HALIDE COLOR PHOTOGRAPHIC MATERIAL

[75] Inventors: Yoichi Suga; Junji Nishigaki, both of Kanagawa, Japan

[73] Assignee: Fuji Photo Film Co., Ltd., Kanagawa, Japan

[21] Appl. No.: 351,527

[22] Filed: Dec. 7, 1994

[30] Foreign Application Priority Data

Dec. 8, 1993 [JP] Japan ..... 5-308214

[51] Int. Cl.[6] ..... G03C 1/46

[52] U.S. Cl. ..... 430/505; 430/544; 430/957; 430/558; 430/574; 430/576; 430/583

[58] Field of Search ..... 430/504, 505, 430/359, 362, 544, 576, 583, 957, 574, 558

[56] References Cited

U.S. PATENT DOCUMENTS

| | | | |
|---|---|---|---|
| 3,990,899 | 11/1976 | Shiba et al. | 430/362 |
| 4,705,744 | 11/1987 | Sasaki et al. | 430/505 |
| 5,085,979 | 2/1992 | Yamagami et al. | 430/505 |
| 5,166,042 | 11/1992 | Nozawa | 430/505 |
| 5,384,234 | 1/1995 | Ueda et al. | 430/583 |
| 5,389,505 | 2/1995 | Nishigaki | 430/586 |

FOREIGN PATENT DOCUMENTS 444028 2/1992 Japan .

*Primary Examiner*—Geraldine Letscher
*Attorney, Agent, or Firm*—Sughrue, Mion, Zinn, Macpeak & Seas

[57] ABSTRACT

The present invention provides a silver halide color photographic material having an excellent color reproducibility and preservability. A novel silver halide color photographic material comprising a support having providing thereon at least one blue-sensitive silver halide emulsion layer containing a yellow color coupler, at least one green-sensitive silver halide emulsion layer containing a magenta color coupler, at least one red-sensitive silver halide emulsion layer containing a cyan color coupler, and at least one silver halide emulsion layer which provides said at least one red-sensitive silver halide emulsion layer with an interlayer effect is described, wherein said at least one silver halide emulsion layer which provides an interlayer effect is spectrally sensitized with a sensitizing dye represented by the following formula (I) and comprises a development inhibitor-releasing compound represented by the following formula (II):

(I)

(II)

5 Claims, No Drawings

SILVER HALIDE COLOR PHOTOGRAPHIC MATERIAL

FIELD OF THE INVENTION

The present invention relates to a color light-sensitive photographic material. More particularly, the present invention relates to a color light-sensitive photographic material which exhibits an excellent color reproducibility and preservability.

BACKGROUND OF THE INVENTION

It has heretofore been known to use an interlayer inhibiting effect as a means of improving the color reproducibility of color photographic light-sensitive materials. Taking color negative light-sensitive material as an example, the color development of a red-sensitive layer upon exposure to white light can be inhibited as compared with that upon exposure to red light by allowing a green-sensitive layer to give an effect of inhibiting development to a red-sensitive layer. In the color negative paper system, gradation is balanced such that the exposure to white light is reproduced in gray on a color print. Therefore, the foregoing interlayer effect allows the development of a higher density cyan color upon exposure to red light than upon exposure to gray. As a result, it is made possible to provide reproduction of red with a reduced cyan development and a higher saturation on the print. Similarly, the development inhibiting effect given by the red-sensitive layer to the green-sensitive layer provides reproduction of green with a high saturation.

As a method for enhancing the interlayer effect there has been known a method which comprises the use of iodine ions released from a silver halide emulsion during development. In this method, the silver iodide content of the layer which provides an interlayer effect is raised while that of the layer which is given an interlayer effect is reduced. Another method for enhancing the interlayer effect is to incorporate in the interlayer effect-providing layer a coupler which reacts with an oxidation product of a developing agent in a paraphenylenediamine color developer to release a development inhibitor as disclosed in JP-A-50-2537 (The term "JP-A" as used herein means an "unexamined published Japanese patent application") (corresponding to U.S. Pat. No. 3,990,899). A further method for enhancing the interlayer effect is a so-called automatic masking which comprises adding a colored coupler to a colorless coupler to mask undesirable absorption by dyes developed from the colorless coupler. By increasing the amount of the colored coupler, this method makes it possible to provide masking more than for undesirable absorption by the colorless coupler and hence give the same effect as the interlayer effect.

These methods are disadvantageous in that when the saturation of primary colors, i.e., red, green and blue are raised, the hue of from yellow to green of a cyanish tint is not faithful. In order to solve this problem, an approach has been proposed as disclosed in JP-A-61-34541 (corresponding to U.S. Pat. No. 4,705,744). In accordance with this proposal, a sharp and faithful color reproduction is attained by the use of a silver halide color photographic material comprising a support having provided thereon at least one blue-sensitive silver halide emulsion layer containing a yellow color coupler, at least one green-sensitive silver halide emulsion layer containing a magenta color coupler, and at least one red-sensitive silver halide emulsion layer containing a cyan color coupler, wherein the weight-averaged wavelength of sensitivity ($\lambda_G$) in the spectral sensitivity distribution of said at least one green-sensitive layer is in the range of not lower than 520 nm to not higher than 580 nm and the weight-averaged wavelength ($\lambda_{-R}$) in the distribution of the magnitude of the interlayer effect which said at least one cyan color-forming red-sensitive silver halide emulsion layer is given by other layers at a wavelength of 500 nm to 600 nm is in the range of higher than 500 nm to not more than 560 nm, with the proviso that ($\lambda_G-\lambda_{-R}$) is not less than 5 nm.

In this approach, an interlayer effect donor layer for the red-sensitive silver halide emulsion layer is provided to obtain the foregoing interlayer effect. The sensitizing dye to be incorporated in the donor layer is designed for the-short wavelength side of the green-sensitive layer. However, it has been found that the sensitizing dye cannot be adsorbed by silver halide grains too strongly and thus can be desorbed therefrom when stored under high temperature and humidity conditions, making it impossible to obtain a sufficient color reproducibility.

On the other hand, JP-A-4-44028 discloses that specific sensitizing dyes can be advantageously used in admixture with the conventional sensitizing dyes taking into account the age stability. However, the spectral absorption obtained by this method is at a wavelength range longer than required. As a result, this method leaves something to be desired in obtaining a desirable color reproducibility.

SUMMARY OF THE INVENTION

It is therefore an object of the present invention to provide a color light-sensitive photographic material which exhibits an excellent color reproducibility and preservability.

The foregoing and other objects of the present invention will become more apparent from the following detailed description and examples.

The foregoing object of the present invention is accomplished with a silver halide color photographic material comprising a support having provided thereon at least one blue-sensitive silver halide emulsion layer containing a yellow color coupler, at least one green-sensitive silver halide emulsion layer containing a magenta color coupler, at least one red-sensitive silver halide emulsion layer containing a cyan color coupler, and at least one silver halide emulsion layer which provides said at least one red-sensitive silver halide emulsion layer with an interlayer effect, wherein said at least one silver halide emulsion layer which provides an interlayer effect is spectrally sensitized with a sensitizing dye represented by the following formula (I) and comprises a development inhibitor-releasing compound represented by the following formula (II):

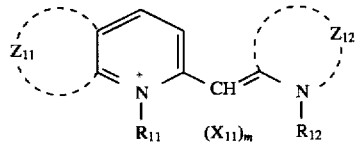

(I)

wherein $R_{11}$ and $R_{12}$ each represents an alkyl group; $Z_{11}$ represents an atomic group necessary for the formation of benzene ring; $Z_{12}$ represents an atomic group necessary for the formation of benzooxazole nucleus; $X_{11}$ represents a charge-balanced paired ion; and m represents 0 or 1, with the proviso that when the sensitizing dye forms an intramolecular salt, m is 0;

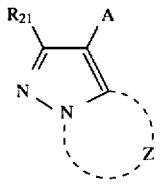

(II)

wherein $R_{21}$ represents a hydrogen atom or substituent; Z represents a nonmetallic atom group necessary for the formation of a 5-membered azole ring containing 2 to 4 nitrogen atoms which may have substituents; and A represents a group which undergoes coupling reaction with the oxidation product of a developing agent to release itself to give a development inhibitor or precursor thereof or a group which undergoes coupling reaction with the oxidation product of a developing agent to release itself and then undergoes reaction with another molecule of the oxidation product of a developing agent to give a development inhibitor or precursor thereof.

The foregoing object of the present invention is accomplished with the silver halide color photographic material as defined above, wherein said at least one layer which provides said at least one red-sensitive silver halide emulsion layer with an interlayer effect contains a sensitizing dye represented by the following formula (III) in an amount of not more than 50 mol% based on the amount of said compound represented by the formula (I):

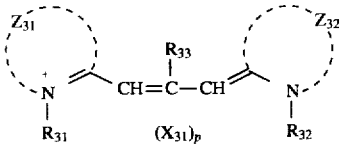

(III)

wherein $R_{31}$ and $R_{32}$ have the same meaning as $R_{11}$ and $R_{12}$ in the formula (I), respectively; $R_{33}$ represents a hydrogen atom, alkyl group or aryl group; $Z_{31}$ and $Z_{32}$ may be the same or different and each represents an atomic group necessary for the formation of a 5- or 6-membered nitrogen-containing heterocyclic group; and $X_{31}$ and p have the same meaning as $X_{11}$ and m in the formula (I).

The inventors have made extensive studies of a sensitizing dye which exhibits spectral absorption at a wavelength of 520 to 540 nm and can be adsorbed by silver halide grains so strongly that it is not desorbed therefrom even under high temperature and humidity conditions. As a result, it was found that monomethine cyanine dyes containing 2-quinoline skeleton are favorable. Preferred among these monomethine cyanine dyes are 2-quinoline-benzooxamonomethine dyes (oxa-2-quinoline dyes). Many of thia-2-quinoline dyes are preferred to oxa-2-quinoline dyes with respect to wavelength. However, when a light-sensitive photographic material comprising these sensitizing dyes was subjected to preservability test, the sensitivity of the blue-sensitive layer was reduced, showing that these sensitizing dyes are not too desirable.

DETAILED DESCRIPTION OF THE INVENTION

The present invention will be further described hereinafter.

The present invention provides a silver halide color photographic material comprising a support having provided thereon at least one blue-sensitive silver halide emulsion layer containing a yellow color coupler, at least one green-sensitive silver halide emulsion layer containing a magenta color coupler, and at least one red-sensitive silver halide emulsion layer containing a cyan color coupler, wherein said at least one cyan-coloring red-sensitive silver halide emulsion layer is subjected to suppression by an interlayer effect from an interlayer effect donor layer spectrally sensitized with a sensitizing dye represented by the following formula (I):

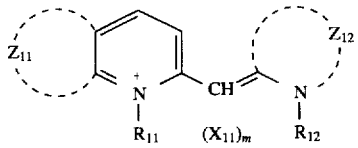

(I)

In the formula (I), $Z_{11}$ represents an atomic group necessary for the formation of benzene ring. At least one atom in the atomic group may be substituted by alkyl group, alkoxy group or aryloxy group. Preferably, the benzene ring formed by $Z_{11}$ is substituted by alkyl group in the 6-position. Examples of the alkyl substituent on $Z_{11}$ include a methyl group, an ethyl group, an n-propyl group, an isopropyl group, a t-butyl group, an n-butyl group, an n-octyl group, an n-decyl group, an n-hexadecyl group, a cyclopentyl group, and a cyclohexyl group. Preferred among these alkyl groups are a methyl group and an ethyl group.

Examples of the alkoxy group include a methoxy group, an ethoxy group, a propoxy group, and a methylenedioxy group. Preferred among these alkoxy groups is a methoxy group.

Examples of the aryloxy group include a phenoxy group, a 4-methylphenoxy group, and a 4-chlorophenoxy group. Preferred among these aryloxy groups is a phenoxy group.

$Z_{12}$ represents an atomic group necessary for the formation of benzooxazole nucleus. The atomic group may contain substituents. $Z_{12}$ preferably represents a benzooxazole nucleus which is substituted by a halogen atom, an alkyl group, an alkoxy group, an alkylthio group or an aryl group in the 5-position. Examples of the halogen substituent on the benzooxazole nucleus include a fluorine atom, a chlorine atom, a bromine atom, and an iodine atom. Preferred among these halogen atoms are a bromine atom and a chlorine atom.

The foregoing alkyl group may have substituents. Examples of such substituents include a methyl group, an ethyl group, an n-propyl group, an isopropyl group, a t-butyl group, an n-butyl group, an n-octyl group, an n-decyl group, an n-hexadecyl group, a cyclopentyl group, a cyclohexyl group, a trifluoromethyl group, and a hydroxyethyl group. Preferred among these substituents is a trifluoromethyl group.

Examples of the foregoing alkoxy group include a methoxy group, an ethoxy group, a propoxy group, and a methylene dioxy group. Preferred among these alkoxy groups is a methoxy group.

Examples of the foregoing alkylthio group include a methylthio group, an ethylthio group, and a propylthio group. Preferred among these alkylthio groups is a methylthio group.

Examples of the foregoing aryl group include a phenyl group, a pentafluorophenyl group, a 4-chlorophenyl group, a 3-sulfophenyl group, and a 4-methylphenyl group. Preferred among these aryl groups is a phenyl group.

In the formula (I), $R_{11}$ and $R_{12}$ each represents an unsubstituted alkyl group having 18 or less carbon atoms (e.g., methyl, ethyl, propyl, butyl, pentyl, octyl, decyl, dodecyl, octadecyl) or substituted alkyl group (e.g., an alkyl group having 18 or less carbon atoms substituted by a carboxyl group, a sulfo group, a cyano group, a halogen atom (e.g., fluorine, chlorine, bromine), a hydroxyl group, an alkoxycarbonyl group having 8 or less carbon atoms (e.g., methoxycarbonyl, ethoxycarbonyl, benzyloxycarbonyl), an alkanesulfonylaminocarbonyl group having 8 or less carbon atoms, an acylaminosulfonyl group having 8 or less carbon atoms, an alkoxy group having 8 or less carbon atoms (e.g., methoxy, ethoxy, benzyloxy, phenethyloxy), an alkylthio group having 8 or less carbon atoms (e.g., methylthio, ethylthio, methylthioethylethyl), an aryloxy group having 20 or less carbon atoms (e.g., phenoxy, p-tollyloxy, 1-naphthoxy, 2-naphthoxy), an acyloxy group having 3 or less carbon atoms (e.g., acetyloxy, propionyloxy), an acyl group having 8 or less carbon atoms (e.g., acetyl, propionyl, benzoyl), a carbamoyl group (e.g., carbamoyl, N,N-dimethylcarbamoyl, morpholinocarbonyl, piperidinocarbonyl), a sulfamoyl group (e.g., sulfamoyl, N,N-dimethylsulfamoyl, morpholinosulfonyl, piperidinosulfonyl) or an aryl group having 20 or less carbon atoms (e.g., phenyl, 4-chlorophenyl, 4-methylphenyl, α-naphthyl)).

Preferred among these alkyl groups represented by $R_{11}$ or $R_{12}$ include an unsubstituted alkyl group (e.g., methyl, ethyl, n-propyl, n-butyl, n-pentyl, n-hexyl), a carboxyalkyl group (e.g., 2-carboxylethyl, carboxymethyl), and a sulfoalkyl group (e.g., 2-sulfoethyl, 3-sulfopropyl, 4-sulfobutyl, 3-sulfobutyl).

More preferable among the alkyl groups represented by $R_{11}$ or $R_{12}$ are a sulfoethyl group, a sulfopropyl group, a sulfobutyl group, a carboxymethyl group, and a carboxyethyl group.

In the formula (I), $X_{11}$ represents a charge-balanced paired ion. The ion which cancels charge in the molecule is selected from the group consisting of an anion and a cation. Examples of the anion include inorganic or organic acid anions (e.g., p-toluenesulfonate, p-nitrobenzenesulfonate, methanesulfonate, methylsulfate, ethylsulfate, perchlorate), and halogen ions (e.g., chloride, bromide, iodide). Examples of the cation include inorganic and organic cations. Specific examples of these inorganic and organic cations include a hydrogen ion, alkali metal ions (e.g., lithium, sodium, potassium and cesium ions), alkaline earth metal ions (e.g., magnesium, calcium and strontium ions), and ammonium ions (e.g., organic ammonium, triethanolammonium and pyridinium ions ).

The suffix m represents 0 or 1. When an intramolecular salt is formed, m is 0.

The formula (III) will be further described hereinafter.

Examples of the nucleus formed by $Z_{31}$ or $Z_{32}$ include a thiazole nucleus {a thiazole nucleus (e.g., thiazole, 4-methylthiazole, 4-phenylthiazole, 4,5-dimethylthiazole, 4,5-diphenylthiazole, 3,4-dihydronaphtho[4,5-a]thiazole), a benzothiazole nucleus (e.g., benzothiazole, 4-chlorobenzothiazole, 5-chlorobenzothiazole, 6-chlorobenzothiazole, 5-nitrobenzothiazole, 4-methylbenzothiazole, 5-methylbenzothiazole, 6-methylbenzothiazole, 5-bromobenzothiazole, 6-bromobenzothiazole, 5-iodobenzothiazole, 5-phenylbenzothiazole, 5-methoxybenzothiazole, 6-methoxybenzothiazole, 5-ethoxybenzothiazole, 5-ethoxycarbonylbenzothiazole, 5-phenoxybenzothiazole, 5-carboxybenzothiazole, 5-acetylbenzothiazole, 5-acetoxybenzothiazole, 5-phenethylbenzothiazole, 5-fluorobenzothiazole, 5-trifluoromethylbenzothiazole, 5-chloro-6-methylbenzothiazole, 5,6-dimethylbenzothiazole, 5,6-dimethoxybenzothiazole, 5,6-methylenedioxybenzothiazole, 5-hydroxy-6-methylbenzothiazole, tetrahydrobenzothiazole, 4-phenylbenzothiazole, 5,6-bismethylthiobenzothiazole), a naphthothiazole nucleus (e.g., naphtho[2,1-d]thiazole, naphtho[1,2-d]thiazole, naphtho[2,3d]thiazole, 5-methoxynaphtho[1,2-d]thiazole, 7-ethoxynaphtho[2,1-d]thiazole, 8-methoxynaphtho[2,1-d]thiazole, 5-methoxynaphtho[2,3-d]thiazole), 8-methylthionaphtho[2,1-d]thiazole}, a thiazoline nucleus (e.g., thiazoline, 4-methylthiazoline, 4-nitrothiazoline), an oxazole nucleus {an oxazole nucleus (e.g., oxazole, 4-methyloxazole, 4-nitrooxazole, 5-methyloxazole, 4-phenyloxazole, 4,5-diphenyloxazole, 4-ethyloxazole), a benzooxazole nucleus (e.g., benzooxazole, 5-chlorobenzooxazole, 5-methylbenzooxazole, 5-bromobenzooxazole, 5-fluorobenzooxazole, 5-phenylbenzooxazole, 5-methoxybenzooxazole, 5-nitrobenzooxazole, 5-trifluoromethylbenzooxazole, 5-hydroxybenzooxazole, 5-carboxybenzooxazole, 6-methylbenzooxazole, 6-chlorobenzooxazole, 6-nitrobenzooxazole, 6-methoxybenzooxazole, 6-hydroxybenzooxazole, 5,6-dimethylbenzooxazole, 4,6-dimethylbenzooxazole, 5-ethoxybenzooxazole, 5-acetylbenzooxazole), a naphthooxazole nucleus (e.g., naphtho[2,1-d]oxazole, naphtho[1,2-d]oxazole, naphtho[2,3-d]oxazole, 5-nitronaphtho[2,1-d]oxazole)}, an oxazoline nucleus (e.g., 4,4-dimethyloxazoline), a selenazole nucleus {a selenazole nucleus (e.g., 4-methylselenazole, 4-nitroselenazole, 4-phenylselenazole), a benzoselenazole nucleus (e.g., benzoselenazole, 5-chlorobenzoselenazole, 5-nitrobenzoselenazole, 5-methoxybenzoselenazole, 5-hydroxybenzoselenazole, 6-nitrobenzoselenazole, 5-chloro-6-nitrobenzoselenazole, 5,6-dimethylbenzoselenazole), a naphthoselenazole nucleus (e.g., naphtho[2,1-d]selenazole, naphtho[1,2-d]selenazole)}, a selenazoline nucleus (e.g., selenazoline, 4-methylselenazoline), a tellurazole nucleus {a tellurazole nucleus (e.g., tellurazole, 4-methyltellurazole, 4-phenyltellurazole), a benzotellurazole nucleus (e.g., benzotellurazole, 5-chlorobenzotellurazole, 5-methylbenzotellurazole, 5,6-dimethylbenzotellurazole, 6-methoxybenzotellurazole), a naphthotellurazole nucleus (e.g., naphtho[2,1-d]tellurazole, naphtho[1,2-d]tellurazole)}, a tellurazoline nucleus (e.g., tellurazoline, 4-methyltellurazoline), a 3,3-dialkylindolenine nucleus (e.g., 3,3-dimethylindolenine, 3,3-diethylindolenine, 3,3-dimethyl-5-cyanoindolenine, 3,3-dimethyl-6-nitroindolenine, 3,3-dimethyl-5-nitroindolenine, 3,3-dimethyl-5-methoxyindolenine, 3,3,5-trimethylindolenine, 3,3-dimethyl-5-chloroindolenine), an imidazole nucleus {an indazole nucleus (e.g., 1-alkylimidazole, 1-alkyl-4-phenylimidazole, 1-arylimidazole), a benzimidazole nucleus (e.g., 1-alkylbenzimidazole, 1-alkyl-5-chlorobenzimidazole, 1-alkyl-5,6-dichlorobenzimidazole, 1-alkyl-5-methoxybenzimidazole, 1-alkyl-5-cyanobenzimidazole, 1-alkyl-5-fluorobenzimidazole, 1-alkyl-5-trifluoromethylbenzimidazole, 1-alkyl-6-chloro-5-cyanobenzimidazole, 1-alkyl- 6-chloro-5-trifluoromethylbenzimidazole, 1-allyl-5,6-dichlorobenzimidazole, 1-allyl-5-chlorobenzimidazole, 1-arylbenzimidazole, 1-aryl-5-chlorobenzimidazole, 1-aryl-5,6-dichlorobenzimidazole, 1-aryl-5-methoxybenzimidazole, 1-aryl-5-cyanobenzimidazole), a naphthoimidazole nucleus (e.g., 1-alkylnaphtho[1,2-d]imidazole, 1-arylnaphtho[1,2-d]imidazole) (Preferred examples of the foregoing alkyl group include $C_{1-8}$ alkyl groups such as unsubstituted alkyl groups (e.g., methyl, ethyl, propyl, isopropyl, butyl) and hydroxylalkyl groups (e.g., 2-hydroxyethyl, 3-hydroxypropyl). Particularly preferred among these alkyl groups are methyl and ethyl. Examples of the foregoing aryl group include a phenyl group, a halogen(e.g., chloro)-substituted phenyl group, an alkyl(e.g., methyl)-substituted phenyl group, and an alkoxy(e.g., methoxy)-substituted phenyl group.), a pyridine nucleus (e.g., 2-pyridine, 4-pyridine, 5-methyl-2-pyridine, 3-methyl-4-pyridine), a quinoline nucleus {a quinoline nucleus (e.g., 2-quinoline, 3-methyl-2-quinoline, 5-ethyl-2-quinoline, 6-methyl-2-quinoline, 6-nitro-2-quinoline, 8-fluoro- 2-quinoline, 6-methoxy-2-quinoline, 6- 8-chloro-2-quinoline, 4-quinoline, 6-ethoxy-4-quinoline, 6-nitro-4-quinoline, 8-chloro-4-quinoline, 8-fluoro- 4-quinoline, 8-methyl-4-quinoline, 8- 6-methyl-4-quinoline, 6-methoxy-4-quinoline, 6-chloro- 4-quinoline, 5,6-dimethyl-4-quinoline), an isoquinoline nucleus (e.g., 6-nitro-l-isoquinoline, 3,4-dihydro- 1-isoquinoline, 6-nitro-3-isoquinoline)}, an imidazo-[4,5-b]quinoxaline nucleus (e.g., 1,3-diethylimidazo[4,5-b]quinoxaline, 6-chloro-l,3-diallylimidazole[4,5-b]quinoxaline), an oxadiazole nucleus, a thiadiazole nucleus, a tetrazole nucleus, and a pyrimidine nucleus.

Preferred among the nuclei formed by $Z_{31}$ or $Z_{32}$ is a benzooxazole nucleus.

$R_{31}$ and $R_{32}$ have the same meaning as $R_{11}$ and $R_{12}$ in the formula (I), respectively. $R_{31}$ and $R_{32}$ each preferably represents a sulfoethyl group, a sulfopropyl group, a sulfobutyl group, a carboxymethyl group or a carboxyethyl group.

$R_{33}$ represents a hydrogen atom or a substituted or unsubstituted alkyl group (e.g., methyl, ethyl, propyl, butyl, hydroxyethyl, trifluoromethyl, 2-chloroethyl, chloromethyl, methoxymethyl, 2-methoxyethyl, benzyl) or an unsubstituted or substituted aryl group (e.g., phenyl, o-carboxyphenyl, p-tollyl, m-tollyl). Preferred among these groups represented by $R_{33}$ are a hydrogen atom, a methyl group, and an ethyl group.

$X_{31}$ and p have the same meaning as $X_{11}$ and m in the formula (I), respectively.

The synthesis of the compound of the present invention represented by the formula (I) can be accomplished in accordance with the methods as described in F. M. Hamer, "Heterocyclic Compounds-Cyanine Dyes and Related Compounds", John Wiley & Sons, New York, London, (1964), D. M. Sturmer, "Heterocyclic Compounds-Special topics in heterocyclic chemistry", Chapter 18, Section 14, pp. 482–515, John Wiley & Sons, New York, London, (1977), "Rodd's Chemistry of Carbon Compounds", 2nd. Ed. vol. IV, part B, (1977), Chapter 15, pp. 369–422, 2nd. Ed. vol. IV, part B, (1985), Chapter 15, pp. 267–296, Elsvier Science Publishing Company Inc., New York, etc.

Specific examples of the compound represented by the formula (I) will be listed below, the present invention should not be construed as being limited thereto.

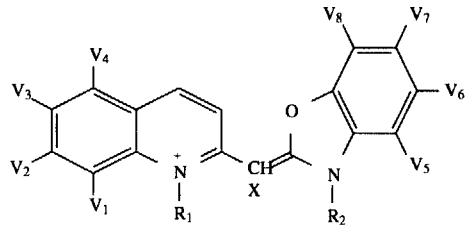
| No. | $V_1$ | $V_2$ | $V_3$ | $V_4$ | $V_5$ | $V_6$ | $V_7$ | $V_8$ | $R_1$ | $R_2$ | X |
|---|---|---|---|---|---|---|---|---|---|---|---|
| I-1 | H | H | H | H | H | Cl | H | H | $C_2H_5$ | $C_2H_5$ | $I^-$ |
| I-2 | H | H | H | H | H | Cl | H | H | $-(CH_2)_4SO_3-$ | $-(CH_2)_4SO_3-$ | $Na^+$ |
| I-3 | H | H | H | H | H | Cl | $CH_3$ | H | $-(CH_2)_3SO_3-$ | $-(CH_2)_3SO_3-$ | 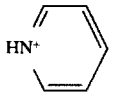 |
| I-4 | H | H | H | H | H | 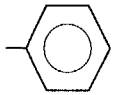 | H | H | $-(CH_2)_4SO_3-$ | $-(CH_2)_4SO_3-$ | $Na^+$ |
| I-5 | H | H | $CH_3$ | H | H | 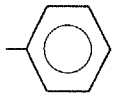 | H | H | $C_2H_5$ | $-(CH_2)_4SO_3-$ | — |
| I-6 | H | H | $CH_3$ | H | H | Br | H | H | $-(CH_2)_3SO_3-$ | $-(CH_2)_3SO_3-$ | $Na^+$ |
| I-7 | H | H | $C_2H_5$ | H | H | $^tAm$ | H | H | $CH_2COOH$ | $-(CH_2)_4SO_3-$ | — |
| I-8 | H | H | 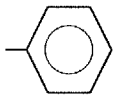 | H | Cl | H | H | H | $C_3H_7$ | $-CH_2CH_2CH(CH_3)SO_3^-$ | — |
| I-9 | H | H | 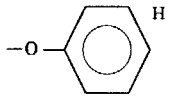 | H | H | H | Cl | H | $CH_3$ | $-CH_3$ | 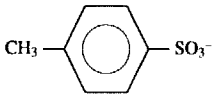 |
| I-10 | $CH_3$ | H | H | H | H | H | H | Cl | $C_2H_5$ | $-(CH_2)_4SO_3-$ | — |

-continued

| | | | | | | | | | | | |
|---|---|---|---|---|---|---|---|---|---|---|---|
| I-11 | H | $CH_3$ | H | H | H | 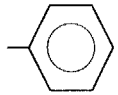 | $CH_3$ | H | $+CH_2)_4SO_3-$ | $+CH_2)_3SO_3-$ | $NH(C_2H_5)_3$ |
| I-12 | H | H | H | $CH_3$ | H | $OCH_3$ | H | H | $+CH_2)_2COOH$ | $+CH_2)_3SO_3-$ | — |
| I-13 | H | $CH_3$ | H | $CH_3$ | H | 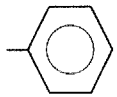 | H | H | $+CH_2)_4SO_3-$ | $+CH_2)_4SO_3-$ | $K^+$ |
| I-14 | H | H | Cl | H | H | Br | H | H | $+CH_2)_4SO_3-$ | $+CH_2)_4SO_3-$ | $H^+$ |
| I-15 | H | H | $-N(C_2H_5)_2$ | H | H | F | H | H | $CH_3$ | $CH_3$ | $I^-$ |
| I-16 | H | H | $CH_3$ | H | H | 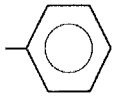 | H | H | $+CH_2)_4SO_3-$ | $+CH_2)_4SO_3-$ | $Na^+$ |
| I-17 | H | H | $OCH_3$ | H | H | 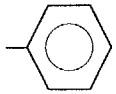 | H | H | $+CH_2)_4SO_3-$ | $+CH_2)_4SO_3-$ | $Na^+$ |
| I-18 | H | $OCH_3$ | $OCH_3$ | H | H | 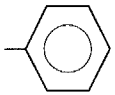 | H | H | $+CH_2)_4SO_3-$ | $+CH_2)_4SO_3-$ | $NH(C_2H_5)_3$ |

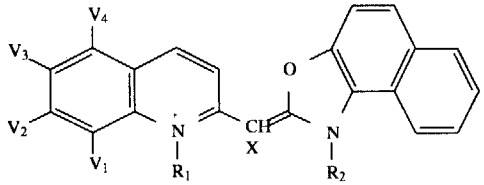

| No. | $V_1$ | $V_2$ | $V_3$ | $V_4$ | $R_1$ | $R_2$ | X |
|---|---|---|---|---|---|---|---|
| 1-19 | H | H | H | H | $C_2H_5$ | $C_2H_5$ | $I^-$ |
| 1-20 | H | H | H | H | $C_2H_5$ | $+CH_2)_3SO_3-$ | — |
| 1-21 | H | H | $CH_3$ | H | $+CH_2)_4SO_3-$ | $+CH_2)_3SO_3-$ | $Na^+$ |

-continued
| | | | | | | | |
|---|---|---|---|---|---|---|---|
| 1-22 | H | $CH_3$ | $CH_3$ | H | $-(CH_2)_4SO_3-$ | $-(CH_2)_2OSO_3-$ | $Na^+$ |
| 1-23 | H | H | 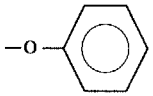 | H | $-(CH_2)_3SO_3-$ | $CH_3$ | — |
| 1-24 | H | $CH_3$ | H | $CH_3$ | $-(CH_2)_2SO_3-$ | $-(CH_2)_3SO_3-$ | $\overset{+}{N}H(C_2H_5)_3$ |
| 1-25 | H | $C_2H_5$ | H | H | $CH_3$ | $CH_3$ | $I^-$ |
| 1-26 | H | H | Cl | H | $^iC_3H_7$ | $C_2H_5$ | $Br^-$ |
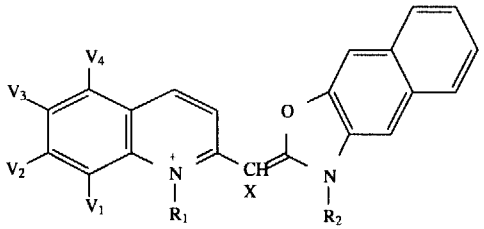
| No. | $V_1$ | $V_2$ | $V_3$ | $V_4$ | $R_1$ | $R_2$ | X |
|---|---|---|---|---|---|---|---|
| 1-27 | H | H | H | H | $CH_3$ | $CH_3$ | $I^-$ |
| 1-28 | H | H | $CH_3$ | H | $-(CH_2)_4SO_3-$ | $-(CH_2)_4SO_3-$ | $Na^+$ |
| 1-29 | H | $CH_3$ | H | H | $-(CH_2)_2SO_3-$ | $-(CH_2)_3SO_3-$ | $\overset{+}{N}H(C_2H_5)_3$ |
| 1-30 | H | $CH_3$ | H | $CH_3$ | $-(CH_2)_2COOH$ | $-(CH_2)_2OSO_3-$ | — |
| 1-31 | H | H | 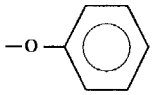 | H | $-(CH_2)_2OSO_3-$ | $-(CH_2)_3SO_3-$ | $Li^+$ |
| 1-32 | H | H | Cl | H | $C_2H_5$ | $-(CH_2)_4SO_3-$ | — |

-continued
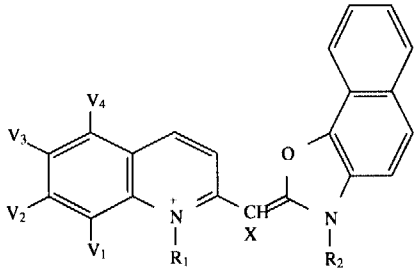
| No. | $V_1$ | $V_2$ | $V_3$ | $V_4$ | $R_1$ | $R_2$ | X |
|---|---|---|---|---|---|---|---|
| I-33 | H | H | H | H | $-(CH_2)_4SO_3-$ | $-(CH_2)_4SO_3-$ | $K^-$ |
| I-34 | H | H | $CH_3$ | H | $-(CH_2)_4SO_3-$ | $-(CH_2)_2SO_3-$ | 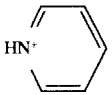 |
| I-35 | H | $CH_3$ | H | H | $CH_3$ | $C_2H_5$ | $I^-$ |
| I-36 | H | $CH_3$ | H | $CH_3$ | $^nC_5H_{11}$ | $-(CH_2)_7OSO_3-$ | — |
| I-37 | H | H | Cl | H | $-(CH_2)_4SO_3-$ | $-(CH_2)_4SO_3-$ | $Na^+$ |

The actual amount of the dye of the formula (I) to be added is in the range of $4\times10^{-6}$ to $2\times10^{-2}$ mol, preferably $5\times10^{-5}$ to $5\times10^{-3}$ mol per mol of silver halide. The time at which the dye is added to the emulsion may be any step during the preparation of the emulsion which has heretofore been known effective.

The dye represented by the formula (III) is preferably used in an amount of 0.5 to 50 mol %, more preferably 5 to 30 mol % based on the weight of the dye of the formula (I).

Specific examples of the compound of the present invention represented by the formula (III) will be listed below, but the present invention should not be construed as being limited thereto.

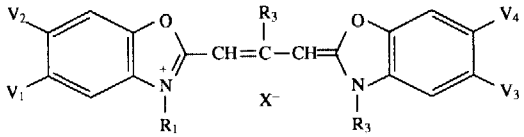
| No. | $V_1$ | $V_2$ | $V_3$ | $V_4$ | $R_1$ | $R_2$ | $R_3$ | X |
|---|---|---|---|---|---|---|---|---|
| III-1 | 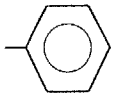 | H | 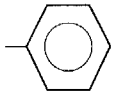 | H | $-(CH_2)_2SO_3-$ | $-(CH_2)_2SO_3-$ | $C_2H_5$ | 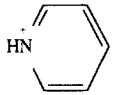 |
| III-2 | Cl | H | Cl | H | $-(CH_2)_3SO_3-$ | $-(CH_2)_3SO_3-$ | $C_2H_5$ | $Na^+$ |
| III-3 | 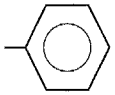 | H | Cl | H | $-(CH_2)_4SO_3-$ | $-(CH_2)_4SO_3-$ | $C_2H_5$ | $Na^+$ |
| III-4 | 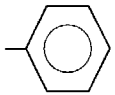 | H | $CH_3$ | H | $-(CH_2)_4SO_3-$ | $-(CH_2)_4SO_3-$ | $C_2H_5$ | $Na^+$ |
| III-5 | Cl | $CH_3$ | Cl | $CH_3$ | $-CH_2CH_2CH(CH_3)SO_3^-$ | $-CH_2CH_2CH(CH_3)SO_3^-$ | $C_2H_5$ | $\overset{+}{N}H(C_2H_5)_3$ |
| III-6 | Cl | H | Cl | H | $-(CH_2)_2COOH$ | $-(CH_2)_2COOH$ | $^nC_3H_7$ | — |
| III-7 | 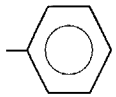 | H | Br | H | $C_2H_5$ | $-(CH_2)_4SO_3-$ | 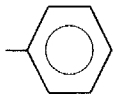 | — |
| III-8 | Br | H | Br | H | $-(CH_2)_4SO_3-$ | $-(CH_2)_4SO_3-$ | $C_2H_5$ | $Na^+$ |
| III-9 | 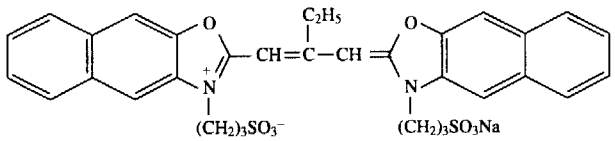 | | | | | | | |

-continued
III-10
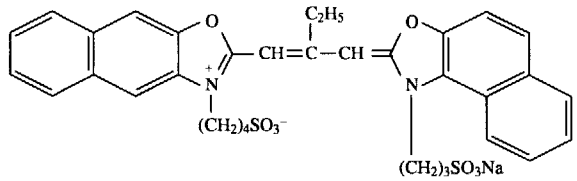
III-11
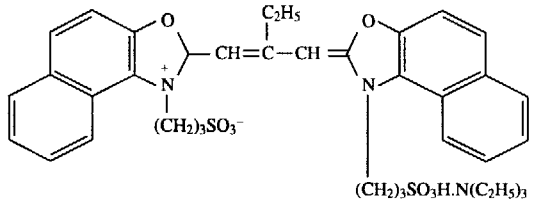
III-12
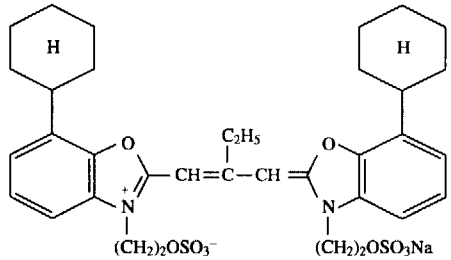
III-13
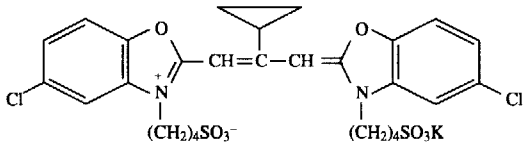
III-14
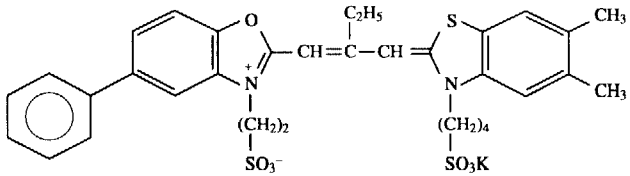

-continued
III-15
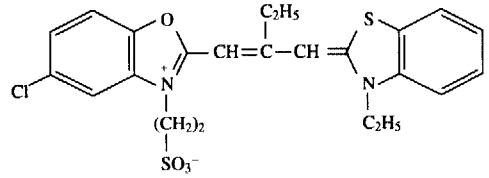
III-16
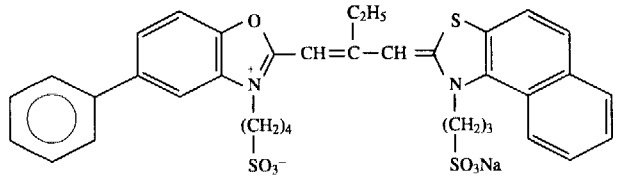
III-17
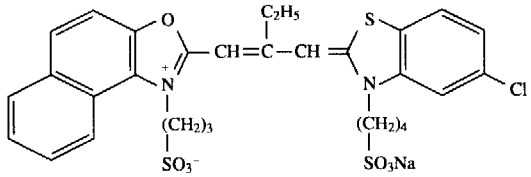
III-18
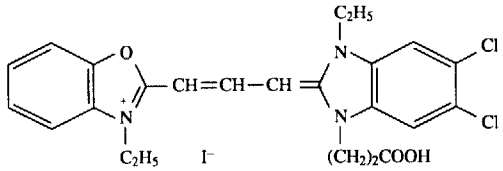
III-19
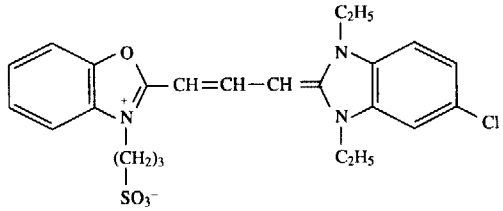

-continued
III-20
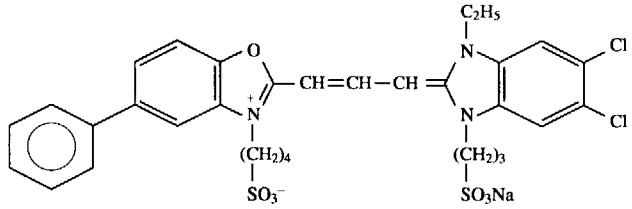
III-21
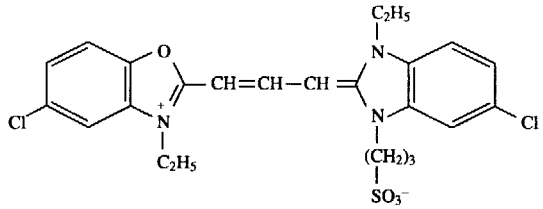
III-22
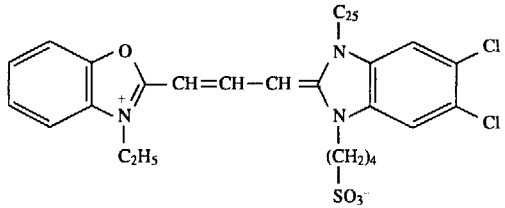
III-23
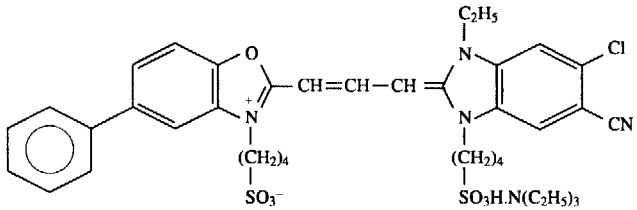
III-24
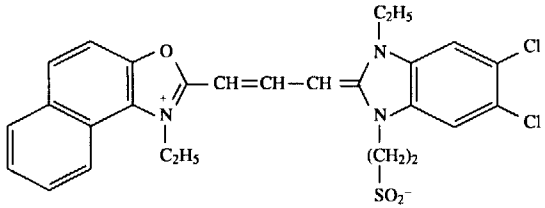

-continued
III-25
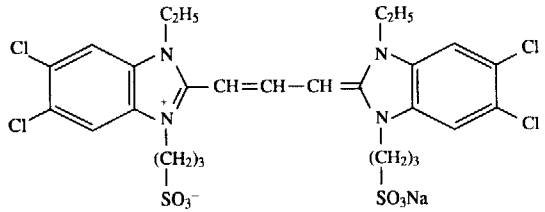
III-26
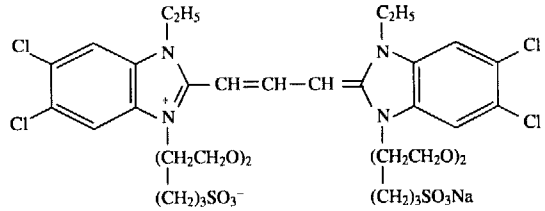
III-27
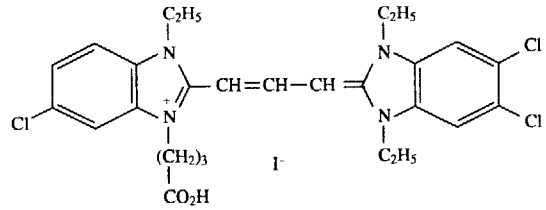
III-28
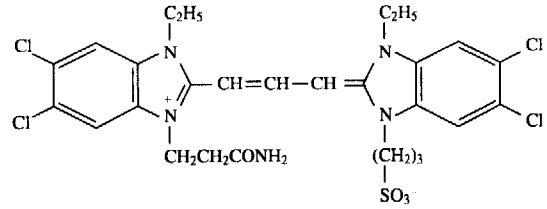

-continued
III-29
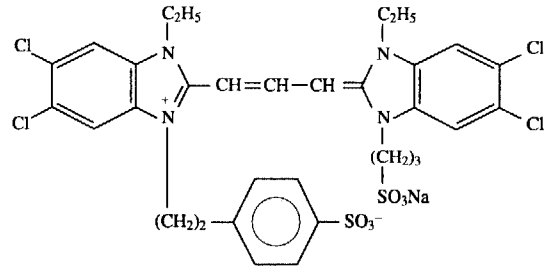
III-30
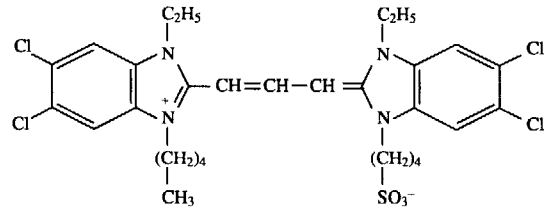
III-31
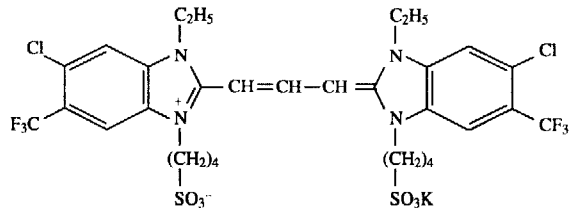
III-32
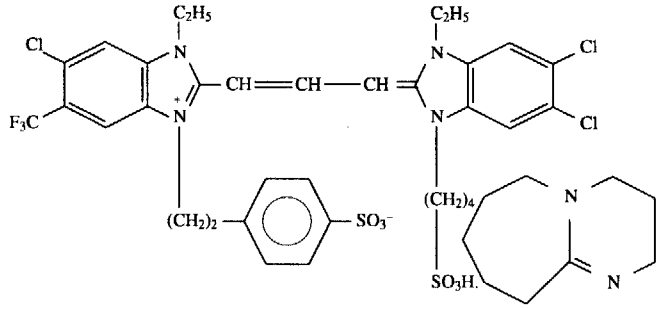

-continued
III-33
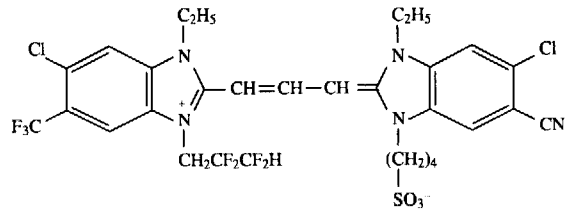
III-34
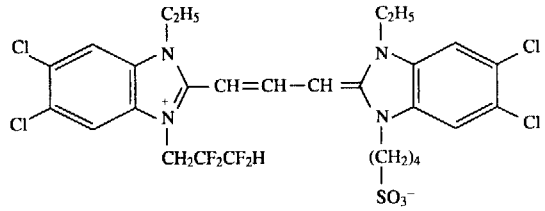
III-35
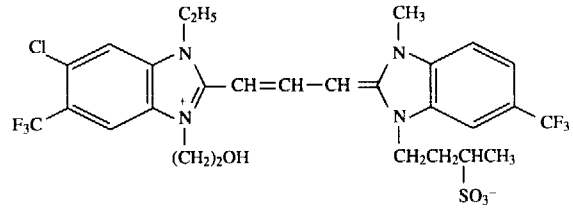
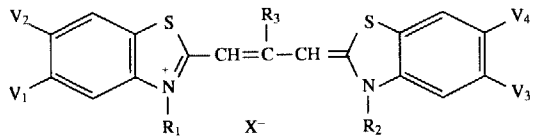
| No. | $V_1$ | $V_2$ | $V_3$ | $V_4$ | $R_1$ | $R_2$ | $R_3$ | X |
|---|---|---|---|---|---|---|---|---|
| III-36 | H | H | H | H | $C_2H_5$ | $C_2H_5$ | $CH_3$ | $Br^-$ |
| III-37 | Cl | H | Cl | H | $(CH_2)_2OH$ | $(CH_2)_2OH$ | $C_2H_5$ | $Br^-$ |
| III-38 | $CH_3$ | H | $CH_3$ | H | $(CH_2)_2OH$ | $(CH_2)_2OH$ | $C_2H_5$ | $Br^-$ |
| III-39 | Cl | H | Cl | H | $C_2H_5$ | $C_2H_5$ | $C_2H_5$ | 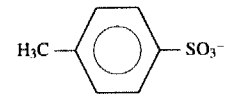 |

-continued
| | | | | | | | | |
|---|---|---|---|---|---|---|---|---|
| III-40 | H | H | H | H | $C_2H_5$ | $-(CH_2)_4SO_3-$ | $CH_3$ | — |
| III-41 | $CH_3$ | H | $CH_3$ | H | $-(CH_2)_3SO_3-$ | $-(CH_2)_3SO_3H$ | $C_2H_5$ | — |
| III-42 | Cl | $CH_3$ | Cl | $CH_3$ | $-(CH_2)_4SO_3-$ | $-(CH_2)_4SO_3-$ | $C_2H_5$ | $Na^+$ |
| III-43 | $OCH_3$ | H | 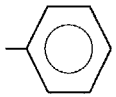 | H | $C_2H_5$ | $-(CH_2)_3SO_3-$ | $C_2H_5$ | — |
| III-44 | Cl | H | Cl | H | $-(CH_2)_3SO_3-$ | $-(CH_2)_3SO_3-$ | $C_2H_5$ | 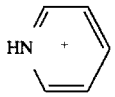 |
| III-45 | Cl | H | Cl | H | $C_2H_5$ | $-(CH_2)_4SO_3-$ | $C_2H_5$ | — |
| III-46 | Cl | H | COOH | H | $C_2H_5$ | $-(CH_2)_4SO_3-$ | $C_2H_5$ | — |
| III-47 | Cl | H | Cl | H | $-(CH_2)_4SO_3-$ | $-CH_2CONHSO_2CH_3$ | $C_2H_5$ | — |
| III-48 | 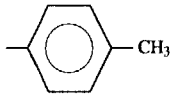 | H | 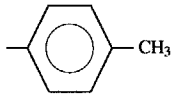 | H | $-(CH_2)_4SO_3-$ | $-(CH_2)_4SO_3-$ | $C_2H_5$ | $\overset{+}{N}H(C_2H_5)_3$ |
III-49
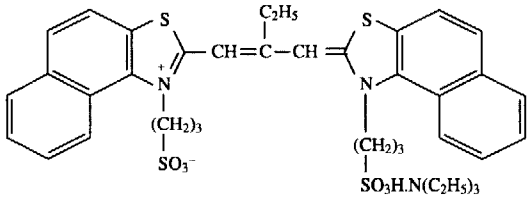
III-50
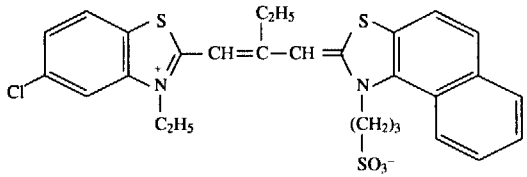

-continued
III-51
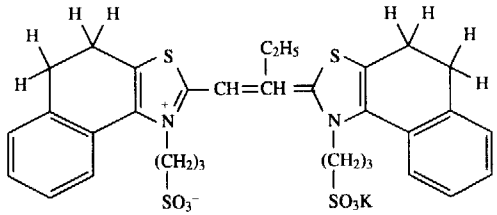
III-52
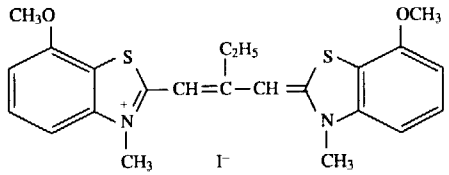
III-53
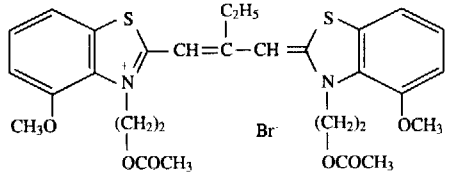
III-54
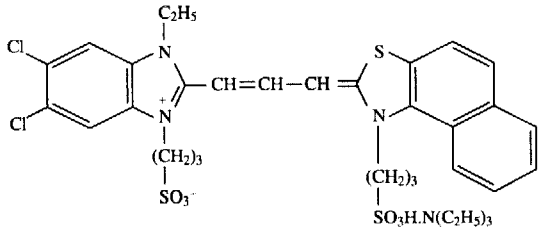
III-55
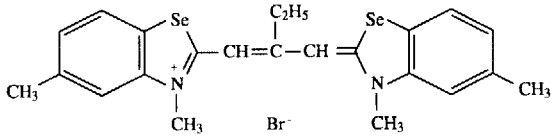

-continued
| | |
|---|---|
| III-56 | 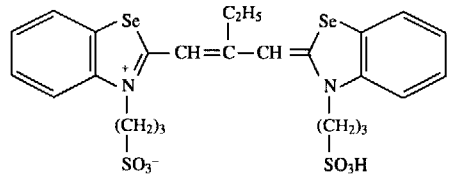 |
| III-57 | 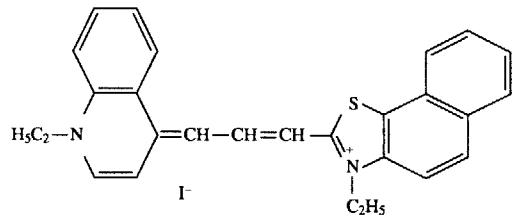 |

In order to attain the improvement in color reproducibility, which is one of the objects of the present invention, it is necessary that a compound represented by the following formula (II) be used as a development inhibitor-releasing compound to be incorporated in the interlayer effect donor layer:

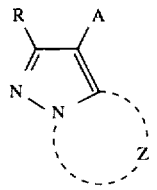

(II)

The compound of the formula (II) to be used in the present invention will be further described hereinafter. Preferred examples of the coupler skeleton represented by the formula (II) include 1H-imidazo[1,2-b]pyrazole, 1H-pyrazolo[1,5-b][1,2,4]triazole, 1H-pyrazolo[5,1-c][1,2,4]triazole, and 1H-pyrazolo[1,5-d]tetrazole, which are represented by the following formulae (P-1), (P-2), (P-3) and (P-4), respectively:

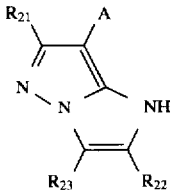

(P-1)

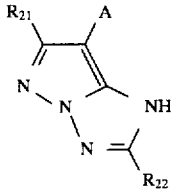

(P-2)

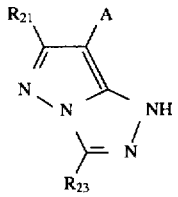

(P-3)

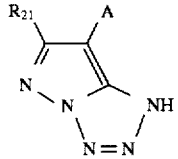

(P-4)

The substituents $R_{21}$, $R_{22}$, $R_{23}$ and A on these compounds will be further described hereinafter.

$R_{21}$ represents a hydrogen atom, a halogen atom, an alkyl group, an aryl group, a heterocyclic group, a cyano group, a hydroxyl group, a nitro group, a carboxyl group, an amino group, an alkoxy group, an aryloxy group, an acylamino group, an alkylamino group, an anilino group, a ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, a heterocyclic oxy group, an azo group, an acyloxy group, a carbamoyloxy group, a silyloxy group, an aryloxycarbonylamino group, an imido group, a heterocyclic thio group, a sulfinyl group, a phosphonyl group, an aryloxycarbonyl group, an acyl group, or an azolyl group. $R_{21}$ may be a divalent group which forms a bis compound.

In some detail, $R_{21}$ represents a hydrogen atom, a halogen atom (e.g., chlorine, bromine), an alkyl group (e.g., a $C_{1-32}$ straight-chain or branched alkyl group, an aralkyl group, an alkenyl group, an alkinyl group, a cycloalkyl group, a cycloalkenyl group, such as methyl, ethyl, propyl, isopropyl, t-butyl, tridecyl, 2-methanesulfonylethyl, 3-(3-pentadecylphenoxy)propyl, 3-{4-{2-[4-(4-hydroxyphenylsulfonyl)phenoxy]dodecaneamido}phenyl}propyl, 2-ethoxytridecyl, trifluoromethyl, cyclopentyl, 3-(2,4-di-t-amylphenoxy)propyl), an aryl group (e.g., phenyl, 4-t-butylphenyl, 2,4-di-t-amylphenyl, 4-tetradecaneamidophenyl), a heterocyclic group (e.g., 2-furyl, 2-thienyl, 2-pyrimidinyl, 2-benzothiazolyl), a cyano group, a hydroxyl group, a nitro group, a carboxyl group, an amino group, an alkoxy group (e.g., methoxy, ethoxy, 2-methoxyethoxy, 2-dodecylethoxy, 2-methanesulfonylethoxy), an aryloxy group (e.g., phenoxy, 2-methylphenoxy, 4-t-butylphenoxy, 3-nitrophenoxy, 3-t-butyloxycarbamoylphenoxy, 3-methoxycarbamoylphenoxy), an acylamino group (e.g., acetamido, benzamido, tetradecaneamido, 2-(2,4-di-t-amylphenoxy)butaneamido, 4-(3-t-butyl-4-hydroxyphenoxy)butaneamido, 2-{4-(4-hydroxyphenylsulfonyl)phenoxy}dodecaneamido), an alkylamino group (e.g., methylamino, butylamino, dodecylamino, diethylamino, methylbutylamino), an anilino group (e.g., phenylamino, 2-chloroanilino, 2-chloro-5-tetradecaneamineanilino, 2-chloro-5-dodecyloxycarbonyl-anilino, N-acetylanilino, 2-chloro-5-{α-(3-t-butyl-4hydroxyphenoxy)dodecaneamido}anilino), a ureide group (e.g., phenylureido, methylureido, N,N-dibutylureido), a sulfamoylamino group (e.g., N,N-dipropylsulfamoylamino, N-methyl-N-decylsulfamoylamino), an alkylthio group (e.g., methylthio, octylthio, tetradecylthio, 2-phenoxyethylthio, 3-phenoxypropylthio, 3-(4-t-butylphenoxy)propylthio), an arylthio group (e.g., phenylthio, 2-butoxy-5-t-octylphenylthio, 3-pentadecylphenylthio, 2-carboxyphenylthio, 4-tetradecaneamidophenylthio), an alkoxycarbonylamino group (e.g., methoxycarbonylamino, tetradecyloxycarbonylamino), a sulfoneamido group (e.g., methanesulfoneamido, hexanedecanesulfoneamido, benzenesulfoneamido, p-toluenesulfoneamido, octadecanesulfoneamido, 2-methyloxy-5-t-butylbenzenesulfoneamido), a carbamoyl group (e.g., N-ethylcarbamoyl, N,N-dibutylcarbamoyl, N-(2-dodecyloxyethyl)carbamoyl, N-methyl-N-dodecylcarbamoyl, N-{3-(2,4-di-t-amylphenoxy)propyl}carbamoyl), a sulfamoyl group (e.g., N-ethylsulfamoyl, N,N-dipropylsulfamoyl, N-(2-dodecyloxyethyl)sulfamoyl, N-ethyl-N-dodecylsulfamoyl, N,N-diethylsulfamoyl), a sulfonyl group (e.g., methanesulfonyl, octanesulfonyl, benzenesulfonyl, toluenesulfonyl), an alkoxycarbonyl group (e.g., methoxycarbonyl, butyloxycarbonyl, dodeyloxycarbonyl, octadecyloxycarbonyl), a heterocyclic oxy group (e.g., 1-phenyltetrazole- 5-oxy, 2-tetrahydropyranyloxy), an azo group (e.g., phenylazo, 4-methoxyphenylazo, 4-pivaloylaminophenylazo, 2-hydroxy-4-propanoylphenylazo), an acyloxy group (e.g., acetoxy), a carbamoyloxy group (e.g., N-methylcarbamoyloxy, N-phenylcarbamoyloxy), a silyloxy group (e.g., trimethylsilyloxy, dibutylmethylsilyloxy), an aryloxycarbonylamino group (e.g., phenoxycarbonylamino), an imido group (e.g., N-succinimido, N-phthalimido, 3-octadecenylsuccimido), a heterocyclic thio group (e.g., 2-benzothiazolylthio, 2,4-diphenoxy-1,3,5-triazole-6-thio, 2-pyridylthio), a sulfinyl group (e.g., dodecanesulfinyl, 3-pentadecylphenylsulfinyl, 3-phenoxypropylsulfinyl), a phosphonyl group (e.g., phenoxyphosphonyl, octyloxyphosphonyl, phenylphosphonyl), an aryloxycarbonyl group (e.g., phenoxycarbonyl), an acyl group (e.g., acetyl, 3-phenylpropanoyl, benzoyl, 4-dodecyloxybenzoyl) or an azoyl group (e.g., imidazolyl, pyrazolyl, 3-chloropyrazole-1-yl, triazolyl). Among these substituents, those which can further have substituents may further have organic substituents or halogen atoms via a carbon atom, an oxygen atom, a nitrogen atom or a sulfur atom.

Preferred among these substituents represented by $R_{21}$ are a hydrogen atom, an alkyl group, an aryl group, an alkoxy group, an aryloxy group, an alkylthio group, a ureide group, a urethane group, and an acylamino group.

$R_{22}$ has the same meaning as $R_{21}$. Preferred examples of the substituent represented by $R_{22}$ include a hydrogen atom, an alkyl group, an aryl group, a heterocyclic group, an alkoxycarbonyl group, a carbamoyl group, a sulfamoyl group, a sulfinyl group, an acyl group, and a cyano group.

$R_{23}$ has the same meaning as $R_{21}$ and is preferably a hydrogen atom, an alkyl group, an aryl group, a heterocyclic group, an alkoxy group, an aryloxy group, an alkylthio group, an arylthio group, an alkoxycarbonyl group, a carbamoyl group or an acyl group, more preferably an alkyl group, an aryl group, a heterocyclic group, an alkylthio group or an arylthio group.

A is preferably a group represented by the following formula (A-1):

$$-\{(L_1)_a-(B)_m\}_p-(L_2)_n-DI \qquad \text{(A-1)}$$

wherein $L_1$ represents a group which causes cleavage of the bond to the part of the formula (A-1) right to $L_1$ (bond to $(B)_m$) after the cleavage of the leftmost bond of the formula (A-1); B represents a group which reacts with the oxidation product of a developing agent to cause the cleavage of the bond to the part of the formula (A-1) right to B; $L_2$ represents a group which causes the cleavage of the bond to the part of the formula (A-1) right to $L_2$ (bond to DI) after the cleavage of the bond to the part of the formula (A-1) left to $L_2$; DI represents a development inhibitor; a, m and n each represents 0 or 1; and p represents 0, 1 or 2, with the proviso that when p is plural, the plurality of $\{(L_1)_a-(B)_m\}$'s may be the same or different.

The reaction step in which the compound represented by the formula (A-1) releases DI during development is represented by, e.g., the following reaction formula. The following reaction formula is an example wherein p is 1.

$$E-(L_1)_a-(B)_m-(L_2)_n-DI \xrightarrow{QDI^+}$$

$$(L_1)_a-(B)_m-(L_2)_n-DI \longrightarrow$$

$$(B)_m-(L_2)_n-DI \xrightarrow{QDI^+}$$

$$(L_2)_n-DI \longrightarrow DI$$

wherein $L_1$, a, B, m, $L_2$, n and DI are as defined in the formula (A-1); $DQI^+$represents an oxidation product of a developing agent; and E represents a pyrazoloazole magenta coupler residue as defined above, i.e., the part of the formula (II) other than A.

In the formula (A-1), the linking group represented by $L_1$ or $L_2$ is a group utilizing cleavage reaction of hemiacetal as described in U.S. Pat. Nos. 4,146,396, 4,652,516, and 4,698,297, a timing group which utilizes an intramolecular nucleophilic reaction to cause cleavage reaction as described in U.S. Pat. No. 4,248,962, a timing group which utilizes an electron transfer reaction to cause cleavage reaction as described in U.S. Pat. Nos. 4,409,323, and 4,421,845, a group which utilizes hydrolysis reaction of iminoketal to cause cleavage reaction as described in U.S. Pat. No. 4,546,073, or a group which utilizes hydrolysis reaction of ester to cause cleavage reaction as described in West German Patent Publication (OLS) No. 2,626,317. $L_1$ and $L_2$ each is connected to A or $E-(L_1)_a-(B)_m$ at a hetero atom contained therein, preferably an oxygen atom, a sulfur atom or a nitrogen atom.

Preferred examples of the group represented by $L_1$ or $L_2$ are listed below.

(1) Group utilizing cleavage reaction of hemiacetal reaction

This is a group represented by the following formula (T-1) as described in U.S. Pat. No. 4,146,396, JP-A-60-249148, and JP-A-60-249149. In the formula (T-1), the symbol * indicates the bonding hand left to $L_1$ or $L_2$ in the group represented by the formula (A-1). The symbol ** indicates the bonding hand right to $L_1$ or $L_2$ in the formula (A-1).

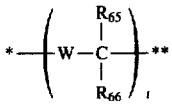

(T-1)

In the formula (T-1), W represents an oxygen atom, a sulfur atom or —$NR_{67}$—. $R_{65}$ and $R_{66}$ each represents a hydrogen atom or a substituent. $R_{67}$ represents a substituent. The suffix t represents 1 or 2. When t is 2, the two (—W—$CR_{65}$ ($R_{66}$)—)'s may be the same or different. Typical examples of the substituents represented by $R_{65}$ and $R_{66}$, and $R_{67}$ include $R_{69}$, $R_{69}CO$—, $R_{69}SO_2$—, $R_{69}NR_{70}CO$—, and $R_{69}NR_{70}SO_2$— in which $R_{69}$ represents an aliphatic group, an aromatic group or a heterocyclic group and $R_{70}$ represents an aliphatic group, an aromatic group, a heterocyclic group or a hydrogen atom. $R_{65}$, $R_{66}$ and $R_{67}$ may be divalent groups which are connected to each other to form a cyclic structure. Specific examples of the group represented by the formula (T-1) include the following groups:

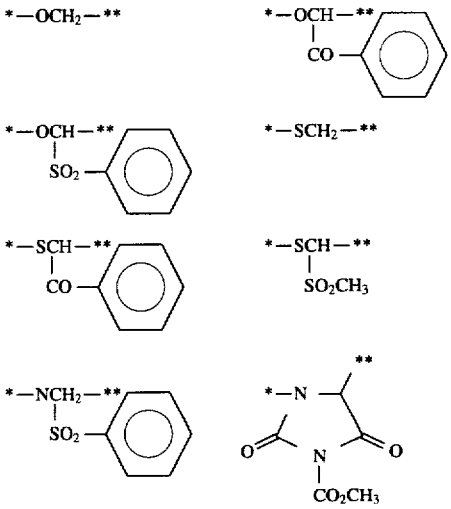

-continued

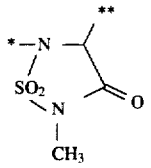

(2) Group which utilizes an intramolecular nucleophilic substitution reaction to cause cleavage reaction A timing group as described in U.S. Pat. No. 4,248,962 may be used. This timing group can be represented by the following formula (T-2):

$$*\text{—}Nu\text{—Link—}E\text{—}^{**} \qquad \text{(T-2)}$$

In the formula (T-2), the symbols * and  are as defined in the formula (T-1). Nu represents a nucleophilic group such as an oxygen atom and a sulfur atom. E represents an electrophilic group which undergoes nucleophilic attack from Nu to cause the cleavage of the bond to . Link represents a linking group which makes three-dimensional relationship such that Nu and E can undergo an intramolecular nucleophilic substitution reaction. Specific examples of the group represented by the formula (T-2) will be listed below.

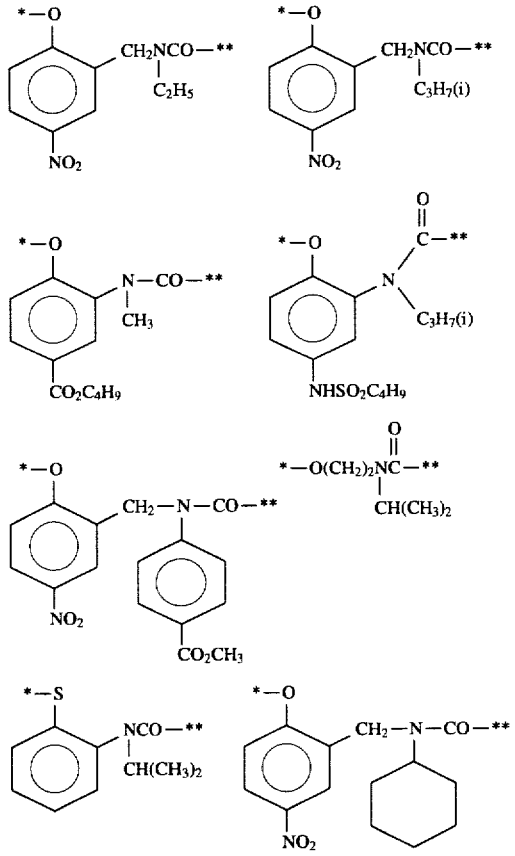

-continued

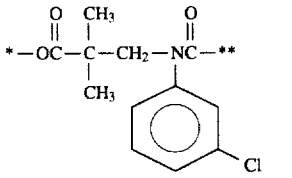

(3) Group which utilizes an electron transfer reaction along a conjugated system to cause cleavage reaction This is a group represented by the following formula (T-3) described in U.S. Pat. Nos. 4,409,323, and 4,421,845.

$$*\text{—}W\text{—}(V_1{=}V_2)_t\text{—}CH_2\text{—}^{**} \qquad \text{(T-3)}$$

wherein $V_1$ and $V_2$ each represents $=CR_{65}$— or nitrogen atom; and the symbols * and **, W, $R_{65}$ and t are as defined in the formula (T-1). Specific examples of the group represented by the formula (T-3) will be listed below.

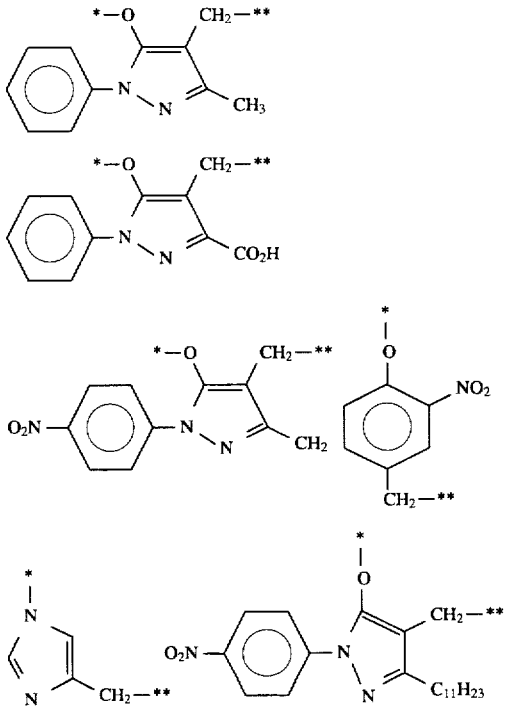

(4) Group which utilizes cleavage reaction by ester hydrolysis

This is a linking group represented by the following formula (T-4) or (T-5) as described in West German Patent Publication (OLS) No. 2,626,315. In these formulae, the symbols * and ** are as defined in the formula (T-1).

$$*\text{—}O\text{—}CO\text{—}^{**} \qquad \text{(T-4)}$$

$$*\text{—}S\text{—}CS\text{—}^{**} \qquad \text{(T-5)}$$

(5) Group utilizing cleavage reaction of iminoketal

This is a linking group represented by the following formula (T-6) as described in U.S. Pat. No. 4,546,073.

$$*\text{—}W\text{—}C(=NR_{68})\text{—}^{**} \qquad \text{(T-6)}$$

wherein the symbols * and ** and W are as defined in the formula (T-1); and $R_{68}$ has the same meaning as $R_{67}$.

Specific examples of the group represented by the formula (T-6) will be listed below.

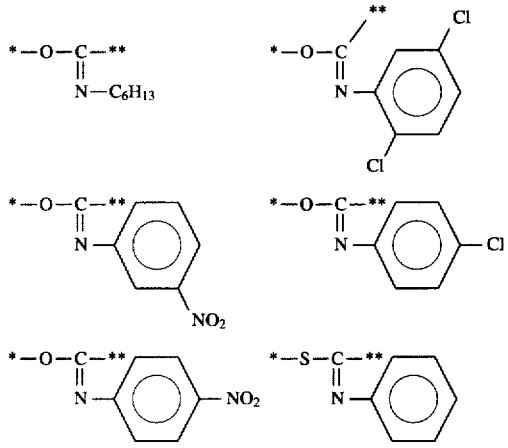

Specific examples of the group represented by B in the formula (A-1) include those represented by each of the following formulae (B-1) to (B-4).

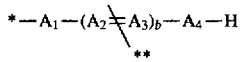

(B-1)

In the formula (B-1), the symbol * represents the position at which the left side of B in the formula (A-1) is connected. The symbol  represents the position at which the right side of B in the formula (A-1) is connected. $A_1$ and $A_4$ each represents an oxygen atom or —N— ($SO_2R_{71}$)—(in which $R_{71}$ represents an aliphatic group, an aromatic group or a heterocyclic group). $A_2$ and $A_3$ each represents a methine group or a nitrogen atom. The suffix b represents an integer of 1 to 3, with the proviso that at least one of $A_2$ and $A_3$ represents a methine group having a bonding hand represented by the symbol . Further, when b is plural, the plurality of $A_2$ and the plurality of $A_3$ each may be the same or different. When $A_2$ and $A_3$ are substituted methine groups, they may or may not be connected to each other to form a cyclic structure (e.g., a benzene ring, a pyridine ring). The group represented by the formula (B-1) undergoes cleavage at the bond * to give a compound which conforms to Kendall-Pelz rule (as described in T. H. James, "The Theory of the Photographic Process", 4th ed., Macmillan Publishing Co., Inc., page 299). This compound reacts with an oxidation product of a developing agent to undergo oxidation.

Specific examples of the group represented by the formula (B-1) will be listed below.

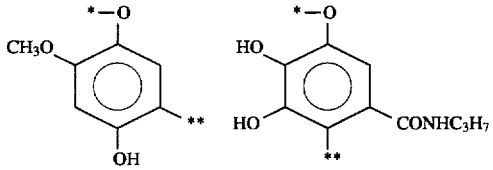

-continued

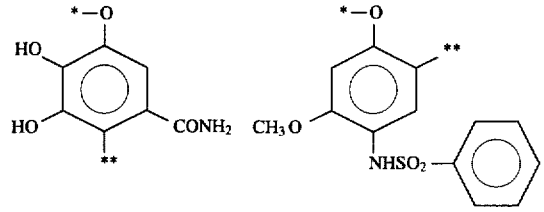

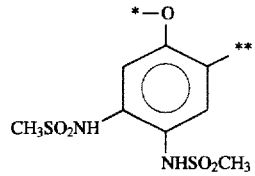

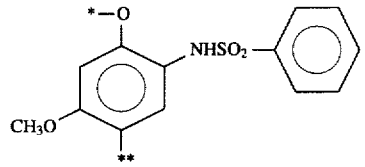

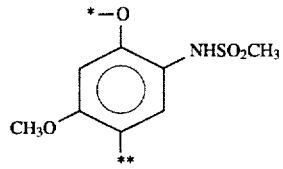

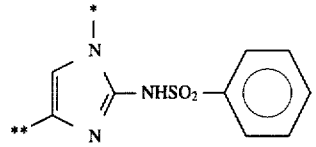

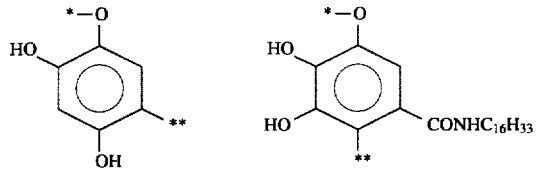

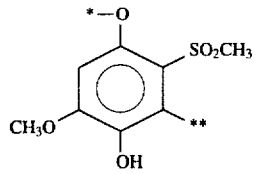

(B-2)

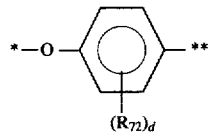

(B-3)

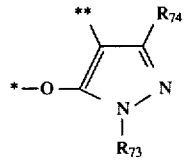

In these formulae, the symbols * and ** are as defined in the formula (B-1). $R_{72}$, $R_{73}$ and $R_{74}$ each represents a group which causes the group represented by the formula (B-2) or (B-3) to function as a coupler having a coupling-off group at

** after the cleavage at *. The suffix d represents 0 or an integer of 1 to 4, with the proviso that when d is plural, the plurality of $R_{72}$ may be the same or different. The plurality of $R_{72}$ may be connected to each other to form a cyclic structure (e.g., a benzene ring). Examples of the group represented by $R_{72}$ include an acylamino group, an alkyl group, and a halogen atom. Examples of the group represented by $R_{74}$ include an acylamino group, an alkyl group, an anilino group, an amino group, and an alkoxy group. Examples of the group represented by $R_{73}$ include a phenyl group, and an alkyl group.

Specific examples of the groups represented by the formula (B-2) or (B-3) will be listed below.

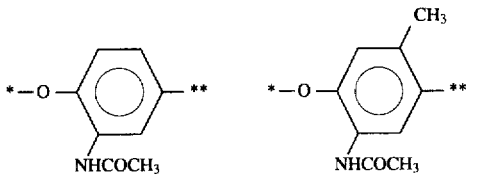

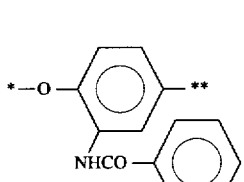

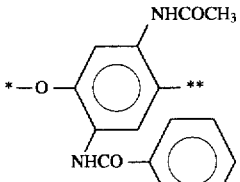

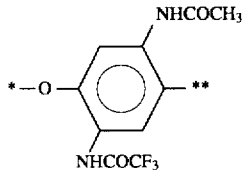

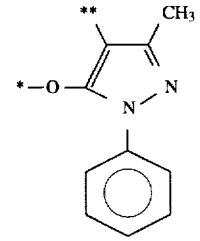

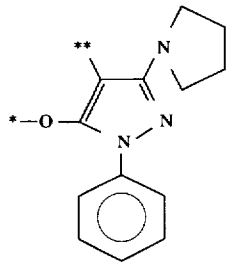

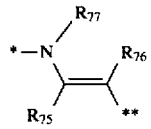

(B-4)

In these formulae, the symbols * and ** are as defined in the formula (B-1). $R_{75}$, $R_{76}$ and $R_{77}$ each represents a substituent. $R_{76}$ and $R_{77}$ may be connected to each other to form a nitrogen-containing heterocyclic group. Alternatively, $R_{75}$ and $R_{77}$ may be connected to each other to form a nitrogen-containing heterocyclic group. The group represented by the formula (B-4) undergoes cleavage at * to give a coupler having a coupling-off group at **.

Specific examples of the group represented by the formula (B-4) will be listed below.

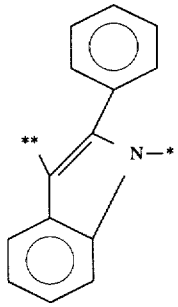

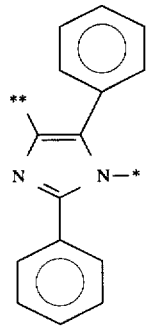

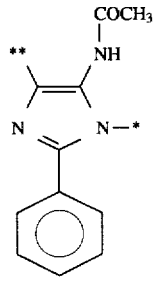

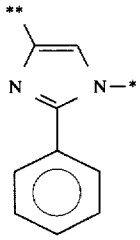

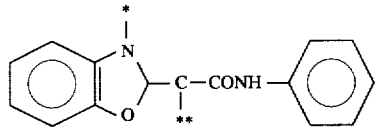

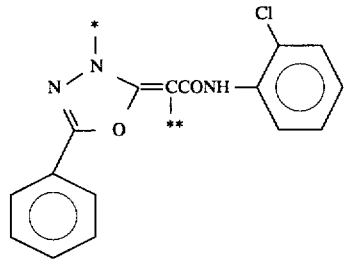

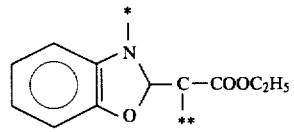

Examples of the group represented by DI in the formula (A-1) include a tetrazolylthio group, a thiadiazolylthio group, an oxadiazolylthio group, a triazolylthio group, a benzimidazolylthio group, a benzthiazolylthio group, a tetrazolylseleno group, a benzoxazolylthio group, a benzotriazolyl group, a triazolyl group, and a benzoimidazolyl group. These groups are disclosed in U.S. Pat. Nos. 3,227,554, 3,384,657, 3,615,506, 3,617,291, 3,733,201, 3,933,500, 3,958,993, 3,961,959, 4,149,886, 4,259,437, 4,095,984, 4,477,563, and 4,782,012, and British Patent 1,450,479.

Specific examples of the group represented by DI will be listed below. In the following formulae, the symbol * indicates the position at which the left side of the group represented by DI in the formula (A-1) is connected.

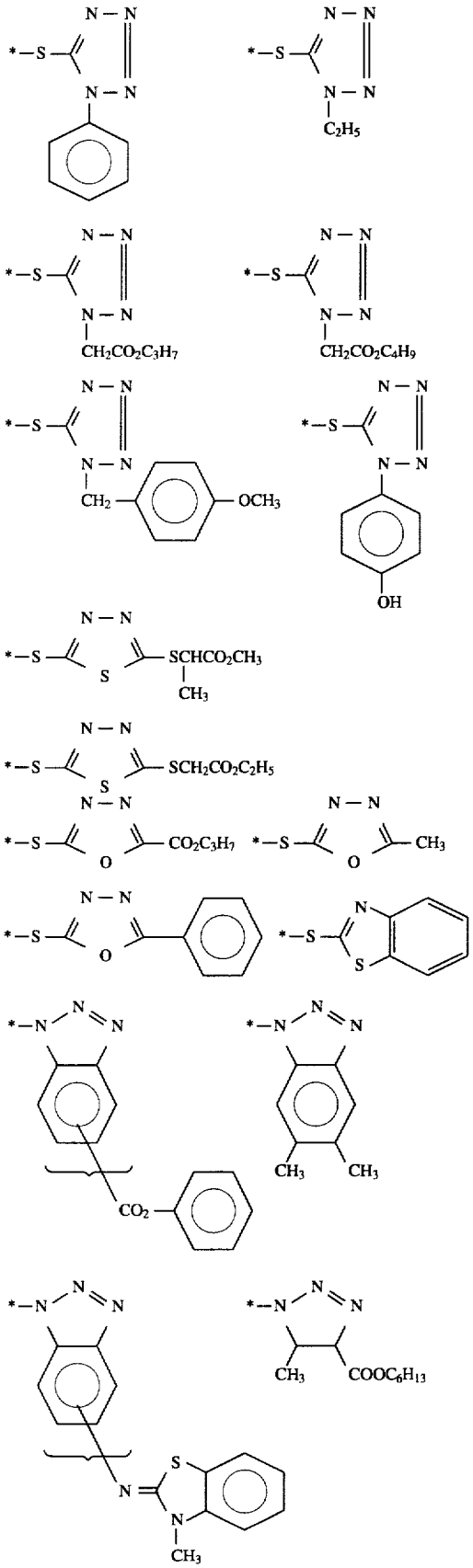

-continued

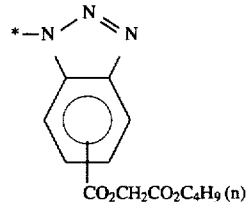

Particularly preferred among the groups represented by the formula (A-1) are those represented by the following formula (A-2), (A-3) or (A-4):

$$-(L_1)-(B)-DI \quad \text{(A-2)}$$

$$-(L_2)-DI \quad \text{(A-3)}$$

$$-DI \quad \text{(A-4)}$$

In these formulae, $L_1$, $L_2$, B and DI are as defined in the formula (A-1).

In the compound of the present invention represented by the formula (II), if A is a group releasable at an oxygen atom, R is preferably a hydrogen atom, an alkyl group or an aryl group in the light of rate of coupling reaction with an oxidation product of a developing agent. Further, if A is a group releasable at the group represented by the formula (B-1), the release group preferably contains a substituent having a Hammett's value $\sigma_p$ of not less than 0.3 in the light of the enhancement of its preservability in the light-sensitive material.

Examples of the substituent having a Hammett's value $\sigma_p$ of not less than 0.3 include a halogenated alkyl group (e.g., trichloromethyl, trifluoromethyl, heptafluoropropyl), a cyano group, an acyl group (e.g., formyl, acetyl, benzoyl), an alkoxycarbonyl group (e.g., methoxycarbonyl, propyloxycarbonyl), an aryloxycarbonyl group (e.g., phenoxycarbonyl), a carbamoyl group (e.g., N-methylcarbamoyl, N-propylcarbamoyl), a sulfamoyl group (e.g., N,N-dimethylsulfamoyl), a sulfonyl group (e.g., methanesulfonyl, benzenesulfonyl), a thiocyanate group, a nitro group, a phosphinyl group (e.g., diethylphosphinyl, dimethylphosphinyl), and a heterocyclic group (e.g., 1-pyrrolyl, 2-benzooxazolyl).

Specific examples of the group having a Hammett's value $\sigma_p$ of not less than 0.3 will be listed below, but the present invention should not be construed as being limited thereto. The figure in the parenthesis indicates the $\sigma_p$ value of the substituent. These $\sigma_p$ values are quoted from "Yakubutsu no kozokasseisokan (Relationship of structural activity of chemical)", Kagaku no ryoiki, No. 122 (extra number), Nankodo.

| | | | |
|---|---|---|---|
| $-CO_2C_2H_5$ | (0.45) | $-CONHCH_3$ | (0.36) |
| $-CF_2CF_2CF_2CF_3$ | (0.52) | $-C_6F_5$ | (0.41) |
| $-COCH_3$ | (0.50) | $-COC_6H_5$ | (0.43) |
| $-P(O)(OCH_3)_2$ | (0.53) | $-SO_2NH_2$ | (0.57) |
| $-SCN$ | (0.52) | $-CO_2C_6H_5$ | (0.44) |
| $-CO_2CH_3$ | (0.45) | $-CONH_2$ | (0.36) |
| $-(CF_2)_3CF_3$ | (0.52) | $-CN$ | (0.66) |

In the compound represented by the formula (II), if A is a group releasable at a nitrogen atom or a sulfur atom, $R_{23}$ is preferably an alkoxy group or an aryloxy group. Further, the substituent on the azole ring moiety represented by Z preferably contains a hydrogen atom, an alkyl group, an aryl group or a heterocyclic group, particularly an aryl group, in the light of storage stability in the light-sensitive material.

Particularly preferred among the compounds represented by each of the formulae (P-1), (P-2), (P-3) and (P-4) listed above as preferred examples of the compound represented by the formula (II) are those represented by each of the formulae (P-1), (P-2) and (P-3), more preferably (P-2) and (P-3), in the light of hue of the resulting magenta dye.

The compound represented by the formula (II) may form a dimer or higher polymer via a group having a valency of 2 or more at the substituent on the azole ring represented by the substituent R or Z.

If the compound represented by the formula (II) forms a polymer, a typical example of the polymer is a homopolymer or copolymer of a addition-polymerizable ethylenically unsaturated compound having a residue of the foregoing compound (color-developing monomer). In this case, the polymer contains a repeating unit represented by the following formula (V). One or more such a color-developing unit may be contained in the polymer. Such a copolymer may contain one or more non-color developing ethylenic monomers.

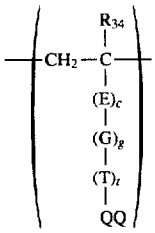

(V)

wherein $R_{34}$ represents a hydrogen atom, $C_{4-1}$ alkyl group or a chlorine atom; E represents —CONH—, —$CO_2$— or a substituted or unsubstituted phenylene group; G represents a substituted or unsubstituted alkylene group, a substituted or unsubstituted phenylene group or a substituted or unsubstituted aralkylene group; T represents —CONH—, —NHCONH—, —$NHCO_2$—, —NHCO—, —OCONH—, —NH—, —$CO_2$—, —OCO—, —CO—, —O—, —O—, —$SO_2$—, —$NHSO_2$— or —$SO_2NH$—; e, g and t each represents 0 or 1, with the proviso that e, g and t are not 0 at the same time; and QQ represents a compound residue produced by the separation of hydrogen atom from the compound represented by the formula (I).

The foregoing polymer is preferably a copolymer of a compound monomer which gives a compound unit represented by the formula (V) and the following non-color developing ethylenic monomer.

Examples of the non-color ethylenic monomer which does not undergo coupling with an oxidation product of an aromatic primary amine developing agent include acrylic acid, α-chloroacrylic acid, α-alkylacrylic acid (e.g., methacrylic acid), esters or amides derived from these acrylic acids (e.g., acrylamide, methacrylamide, n-butylacrylamide, t-butylacrylamide, diacetone acrylamide, methylene bisacrylamide, methyl acrylate, ethyl acrylate, n-propyl acrylate, n-butyl acrylate, t-butyl acrylate, iso-butyl acrylate, 2-ethylhexyl acrylate, n-octyl acrylate, lauryl acrylate, methyl methacrylate, ethyl methacrylate, n-butyl methacrylate, β-hydroxy methacrylate), vinyl ester (e.g., vinyl acetate, vinyl propionate, vinyl laurate), acrylonitrile, methacrylonitrile, aromatic vinyl compound (e.g., styrene and derivatives thereof, such as vinyltoluene, divinylbenzene, vinylacetophenone and sulfostyrene), itaconic acid, citraconic acid, crotonic acid, vinylidene chloride, vinyl alkyl ether (e.g., vinyl ethyl ether), ester maleate, N-vinyl-2-pyrolidone, and N-vinylpyridine.

Particularly preferred among these monomers are ester acrylate, ester methacrylate, and ester maleate. Two or more of these non-color developing ethylenic monomers may be used in combination. Examples of such a combination include a combination of methyl acrylate and butyl acrylate, a combination of butyl acrylate and styrene, a combination of butyl methacrylate and methacrylic acid, and a combination of methyl acrylate and diacetone acrylamide.

As known in the field of polymer coupler, when a polymer having a repeating unit represented by the foregoing formula (V) is synthesized, the non-color developing ethylenic monomer to be copolymerized with the ethylenic monomer having a coupler residue of the present invention can be selected such that it has good effects on the physical and/or chemical properties of the resulting copolymer, such as solubility, compatibility with binder in photographic colloid composition such as gelatin, plasticity, and thermal stability.

The polymer compound to be used in the present invention (lipophilic polymer compound obtained by the polymerization of a vinyl monomer giving a compound unit represented by the foregoing formula (V)) may be subjected to emulsion dispersion in the form of latex of organic solvent solution in an aqueous solution of gelatin or may be directly subjected to emulsion polymerization.

The emulsion dispersion of such a lipophilic polymer compound in the form of latex in an aqueous solution of gelatin can be accomplished by the process as described in U.S. Pat. No. 3,451,820. The emulsion polymerization of the lipophilic polymer compound can be accomplished by the process as described in U.S. Pat. Nos. 4,080,211, and 3,370,952.

The compound of the present invention represented by the formula (II) can be used in combination with other couplers. The proportion of the compound of the formula (II) in the combination is preferably not less than 5 mol %, more preferably not less than 10 mol %.

Specific examples of the compound of the present invention represented by the formula (II) to be used in the present invention will be listed below, but the present invention should not be construed as being limited thereto.

II-1
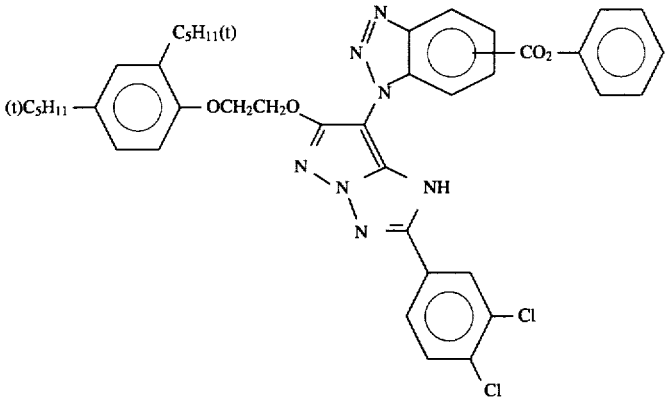
II-2
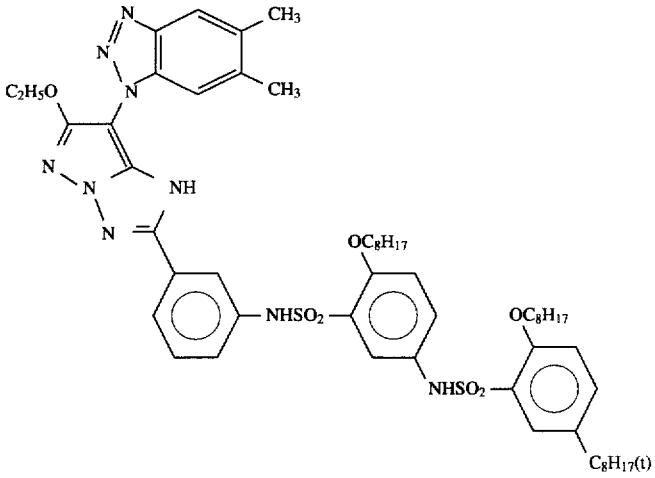
II-3
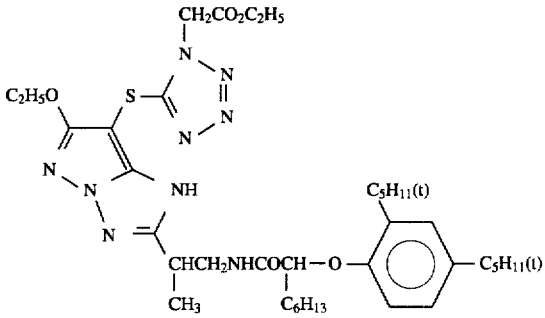
II-4
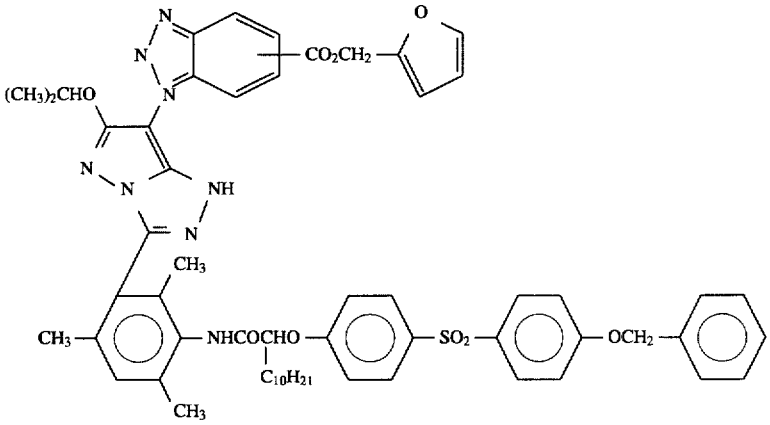

-continued
II-5
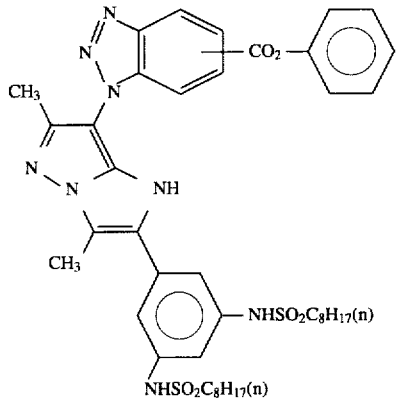
II-6
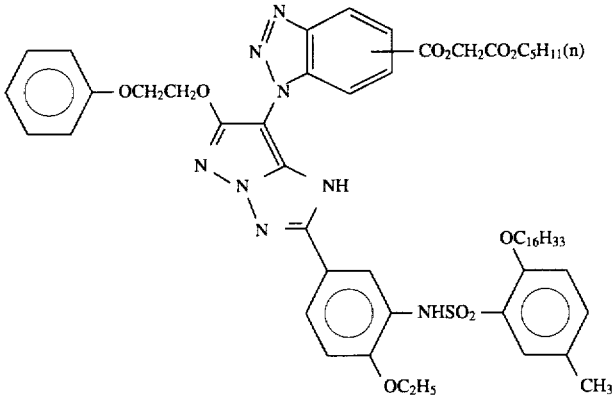
II-7
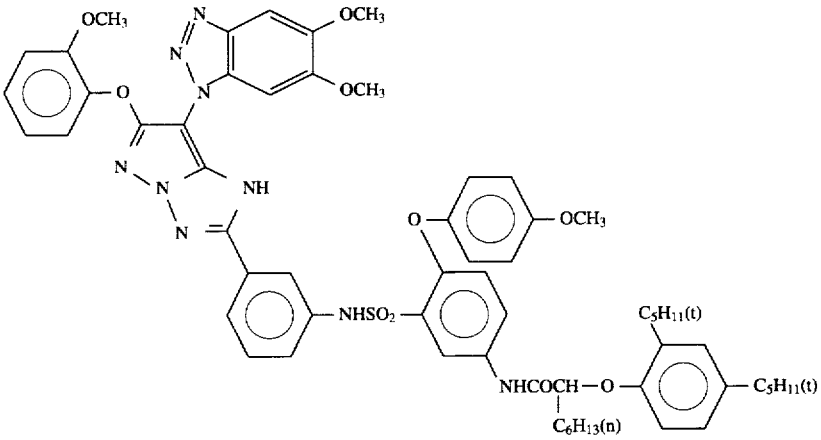

-continued
II-8
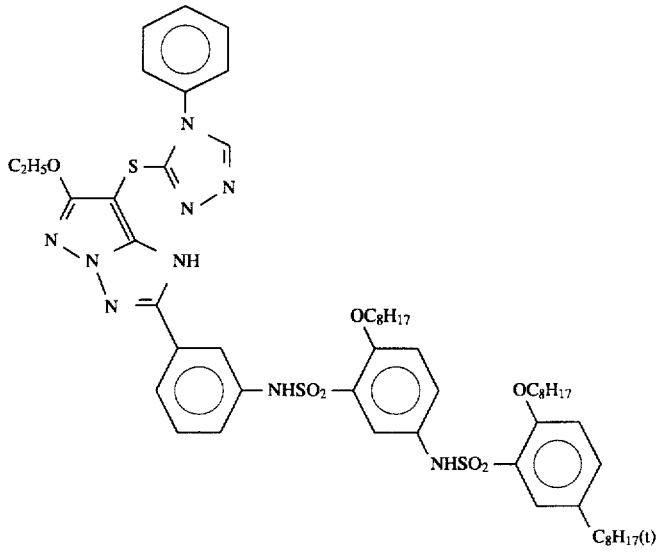
II-9
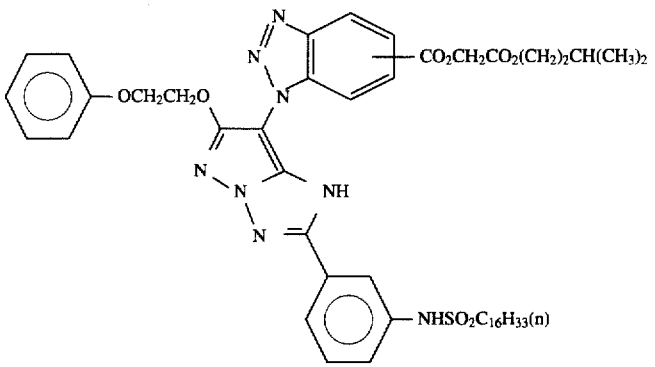
II-10
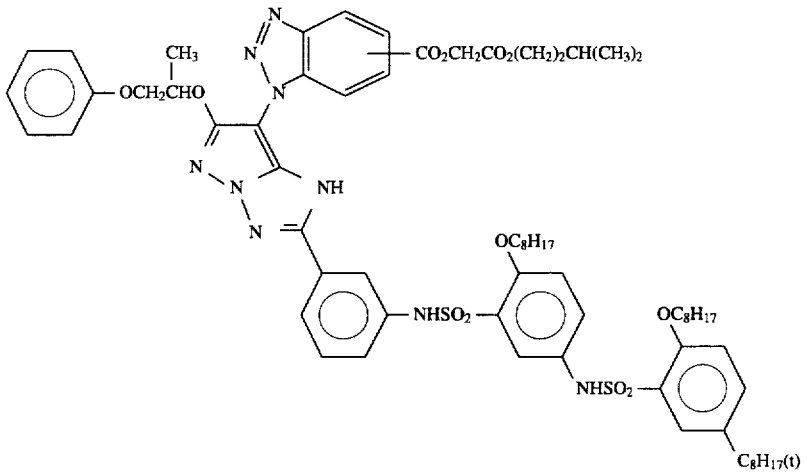

-continued
II-11
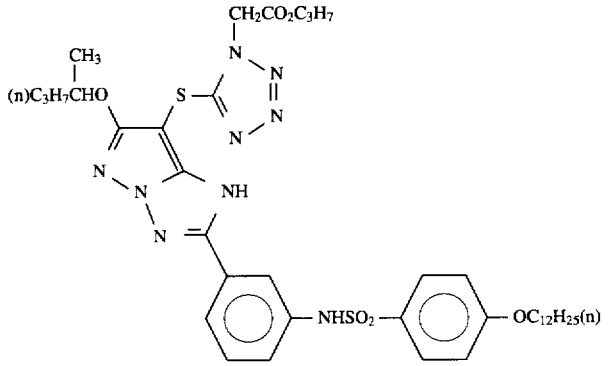
II-12
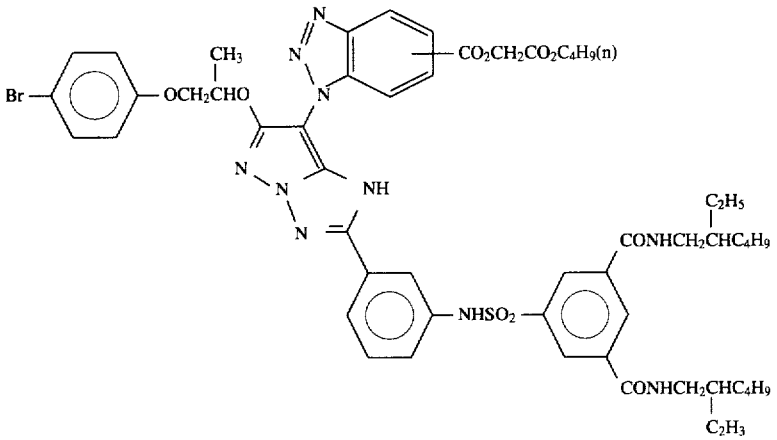
II-13
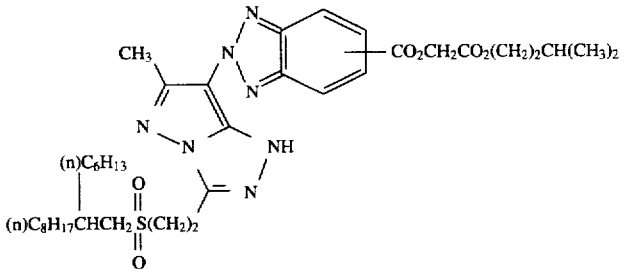
II-14
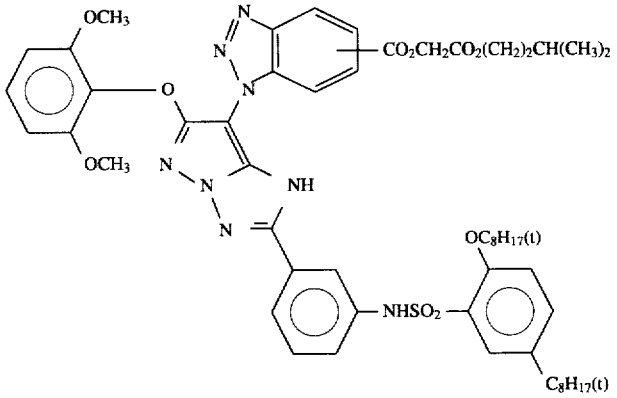

-continued
II-15
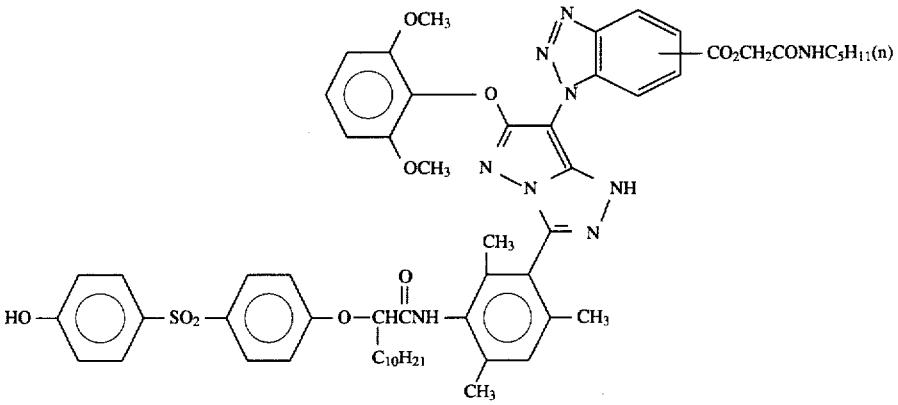
II-16
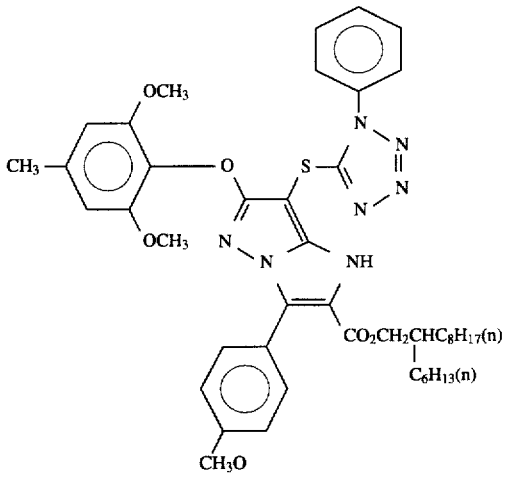
II-17
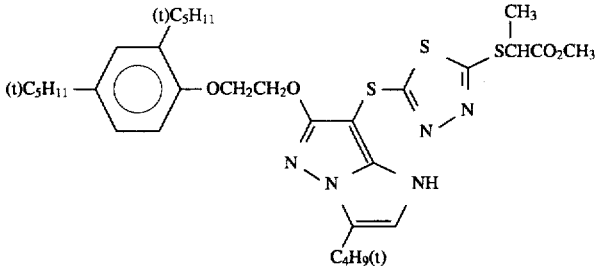
II-18
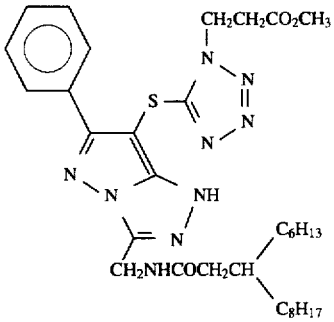

-continued
II-19
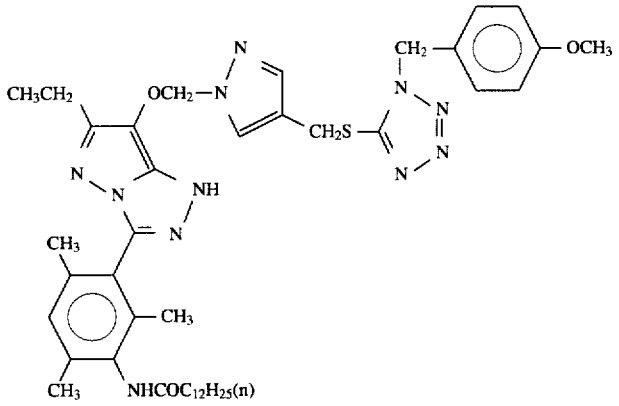
II-20
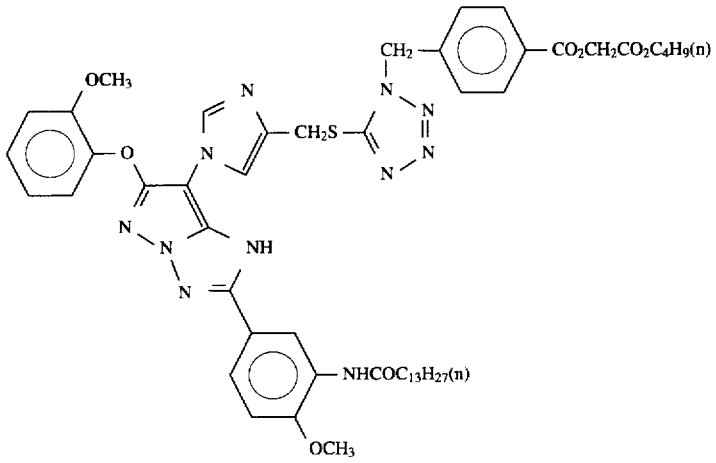
II-21
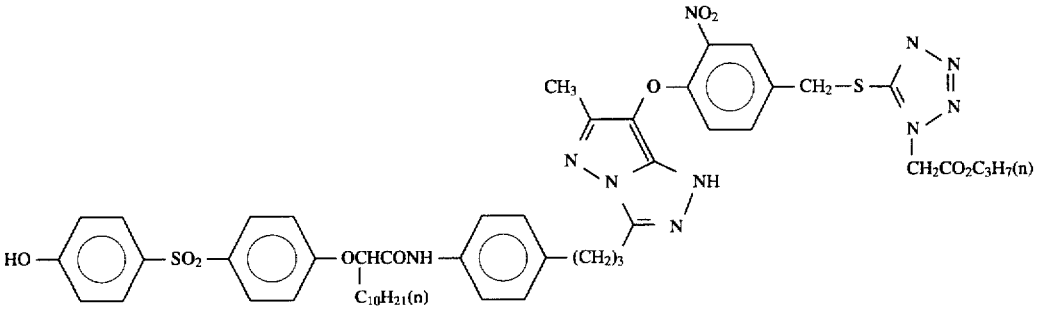
II-22
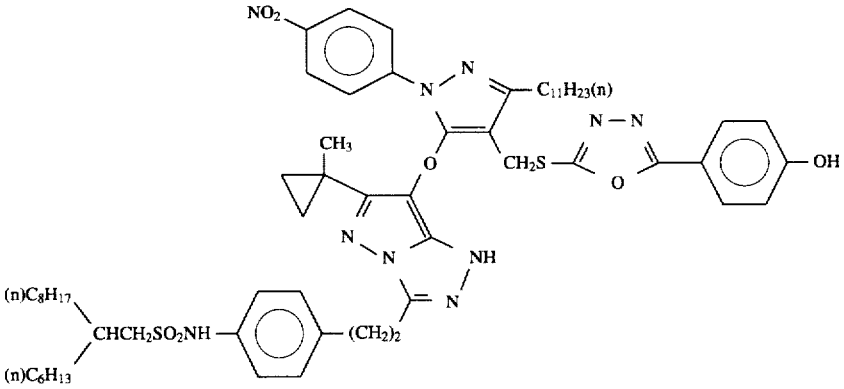

-continued
II-23
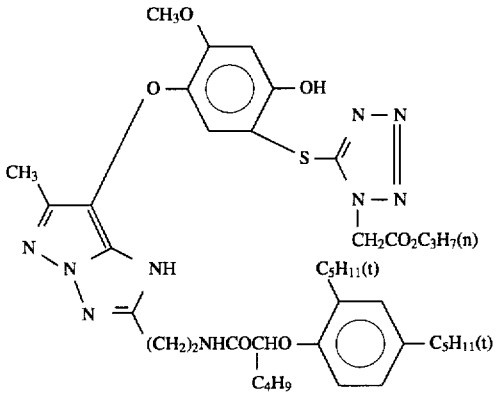
II-24
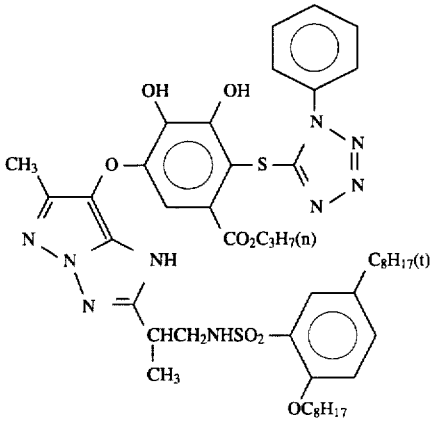
II-25
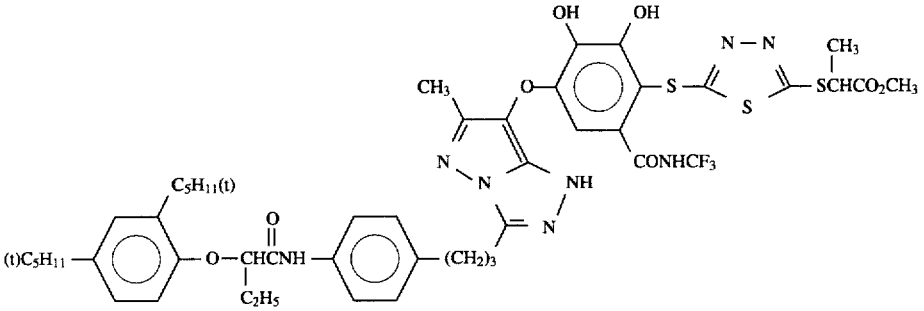
II-26
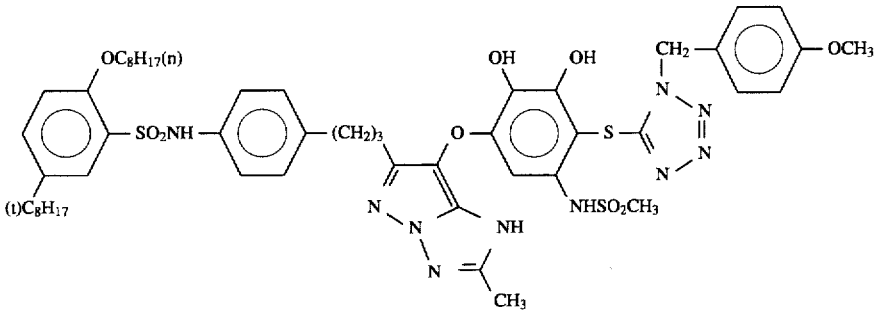
II-27
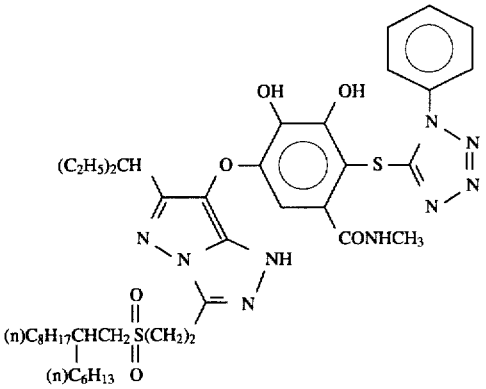

-continued
II-28
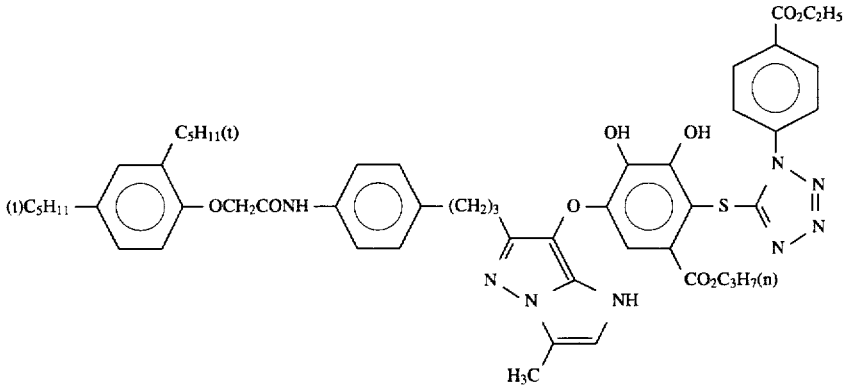
II-29
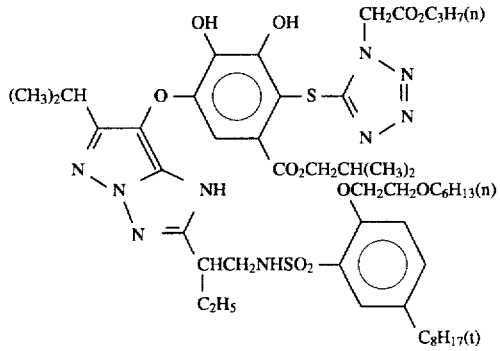
II-30
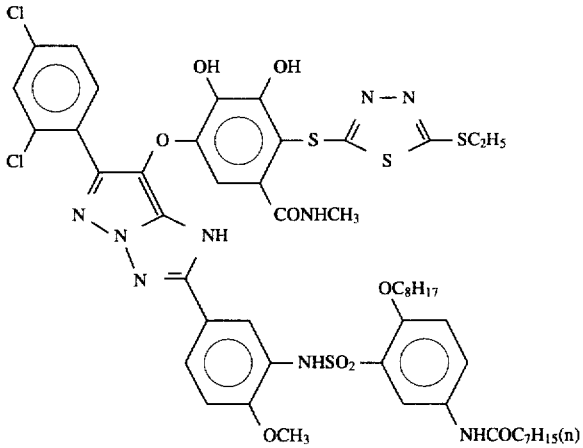

-continued

II-31

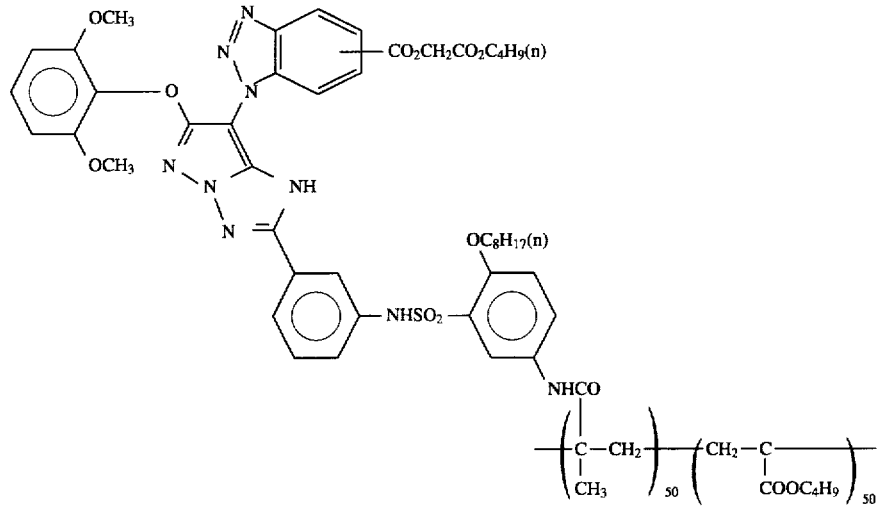

II-32

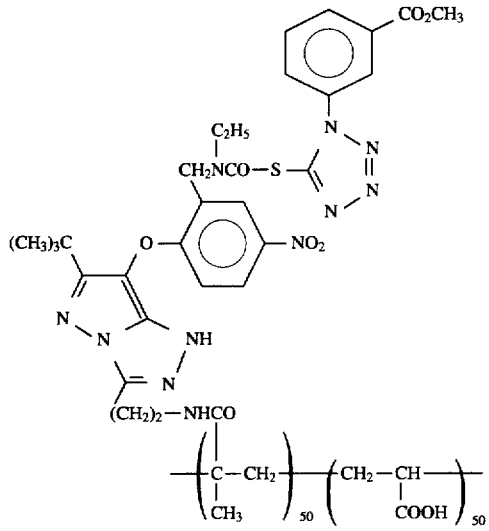

The yellow filter layer preferably contains colloidal silver and/or a yellow dye. In particular, a yellow dye as described in JP-A-3-167546 is preferably used.

A suitable silver halide to be incorporated in the photographic emulsion layer in the photographic light-sensitive material to be used in the present invention is silver bromoiodide, silver chloroiodide or silver bromochloroiodide containing silver iodide in an amount of about 30 mole % or less. Particularly suitable is silver bromoiodide containing silver iodide in an amount of about 2 mole % to about 10 mole %.

Silver halide grains in the present invention emulsions may be so-called regular grains having a regular crystal form, such as cube, octahedron and tetradecahedron, or those having an irregular crystal form such as sphere and plate, those having a crystal defect such as twinning plane, or those having a combination of these crystal forms.

The silver halide grains may be either fine grains of about 0.2 μm or smaller in diameter or large-size grains having a projected area diameter of up to about 10 μm. The emulsion may be either a monodisperse emulsion or a polydisperse emulsion.

The preparation of the silver halide photographic emulsion which can be used in the present invention can be accomplished by any suitable method as described in *Research Disclosure* No. 17643 (December 1978), pp. 22–23, "I. Emulsion Preparation and Types", ibid. No. 18716 (November 1979), page 648, and ibid. No. 307105 (November 1989), pp. 863–865, P. Glafkides, "Chimie et Physique Photographique", Paul Montel (1967), G. F. Duffin, "Photographic Emulsion Chemistry", Focal Press, (1966), and V. L. Zelikman et al., "Making and Coating Photographic Emulsion Focal Press", (1964).

Furthermore, monodisperse emulsions as described in U.S. Pat. Nos. 3,574,628 and 3,655,394, and British Patent 1,413,748 can be preferably used in the present invention.

Tabular grains having an aspect ratio of about 3 or more can be used in the present invention. The preparation of such tabular grains can be easily accomplished by any suitable method as described in Gutoff, "Photographic Science and Engineering", vol. 14, pp. 248–257, (1970), U.S. Pat. Nos. 4,434,226, 4,414,310, 4,433,048, and 4,439,520, and British Patent 2,112,157.

The individual silver halide crystals may have either a homogeneous structure or a heterogeneous structure composed of a core and an outer shell differing in halogen composition, or may have a layered structure. Furthermore, the grains may have fused thereto a silver halide having a different halogen composition or a compound other than silver halide, e.g., silver thiocyanate, lead oxide, etc. by an epitaxial junction. Mixtures of grains having various crystal forms may also be used.

The above mentioned emulsion may be of the surface latent image type in which latent images are mainly formed on the surface of grains or the internal latent image type in which latent images are mainly formed inside grains or the type in which latent images are formed both on the surface and inside grains. The emulsion needs to be a negative type emulsion. If the emulsion is of the internal latent image type, it may be a core/shell type internal latent image emulsion as disclosed in JP-A-63-264740. A process for the preparation of such a core/shell type internal latent image emulsion is described in JP-A-59-133542. In this emulsion, the thickness of the shell depends on development process, etc. and is preferably in the range of 3 to 40 nm, particularly 5 to 20 nm.

The silver halide emulsion to be used in the present invention is normally subjected to physical ripening, chemical ripening and spectral sensitization. Additives to be used in these steps are described in *Research Disclosure* Nos. 17643, 18716 and 307105 as tabulated below.

| Kind of additive | RD17643 [Dec. 1978] | RD18716 [Nov. 1979] | RD307105 [Nov. 1989] |
|---|---|---|---|
| 1. Chemical sensitizer | p. 23 | p. 648 right column (RC) | p. 866 |
| 2. Sensitivity increasing agent | | p. 648 right column (RC) | |
| 3. Spectral sensitizer and supersensitizer | pp. 23–24 | p. 648 RC–p. 649 RC | pp. 866–868 |
| 4. Brightening agent | p. 24 | p. 647 RC | p. 868 |
| 5. Antifoggant and stabilizer | pp. 24–25 | p. 649 RC | pp. 868–870 |
| 6. Light absorbent, filter dye, and ultraviolet absorbent | pp. 25–26 | p. 649 RC–p. 650 LC | p. 873 |
| 7. Stain inhibitor | p. 25 RC | p. 650 LC–RC | p. 872 |
| 8. Dye image stabilizer | p. 25 | p. 650 LC | p. 872 |
| 9. Hardening agent | p. 26 | p. 651 LC | pp. 874–875 |
| 10. Binder | p. 26 | p. 650 LC | pp. 873–874 |
| 11. Plasticizer and lubricant | p. 27 | p. 650 RC | p. 876 |
| 12. Coating aid and surface active agent | pp. 26–27 | p. 650 RC | pp. 875–876 |
| 13. Antistatic agent | p. 27 | p. 650 RC | pp. 876–877 |
| 14. Matting agent | | | pp. 878–879 |

The silver halide photographic material of the present invention can exert its effects more easily when applied to film units with lens as described in JP-B-2-32615 (The term "JP-B" as used herein means an "examined Japanese patent publication"), and JP-B-U-3-39784 (The term "JP-B-U" as used herein means an "examined Japanese utility model publication").

The present invention will be further described in the following examples, but the present invention should not be construed as being limited thereto.

EXAMPLE 1

Preparation of emulsion (i) 1,000 ml of an aqueous solution containing 3 g of gelatin and 3.2 g of KBr was kept at a temperature of 60° C. with stirring. (ii) To the aqueous solution were then added an aqueous solution of silver nitrate (containing 8.2 g of $AgNO_3$) and an aqueous solution of a halide (containing 5.7 g of KBr) by double jet process in 1 minute. (iii) To the mixture was then added 21.5 g of gelatin. The mixture was then heated to a temperature of 75° C. (iv) To the mixture were then added an aqueous solution of silver nitrate (containing 136.3 g of $AgNO_3$) and an aqueous solution of a halide (containing KI in an amount of 2.0 mol % based on the amount of KBr) by double jet process at an accelerated flow rate in 51 minutes. During this process, the silver potential was kept at 0 mV with respect to a saturated calomel electrode for 46 minutes from the beginning. (v) The mixture was heated to a temperature of 40° C. where an aqueous solution of silver nitrate (containing 3.2 g of $AgNO_3$) and an aqueous solution of KI (containing 3.2 g of KI) were then added thereto in 5 minutes. (vi) Thereafter, an aqueous solution of silver nitrate (containing 25.4 g of $AgNO_3$) and an aqueous solution of KBr were added to the mixture by double jet process in 5.35 minutes. During this process, the silver potential was kept at −50 mV with respect to a saturated calomel electrode. (vii) The resulting emulsion was desalted by flocculation method. To the emulsion was then added gelatin. The emulsion was then adjusted to pH 5.5 and pAg 8.7. The emulsion was then subjected to optimum chemical sensitization with sodium thiosulfate, potassium thiocyanate, chloroauric acid, and dimethyl selenourea. In Emulsion F, tabular grains having an average diameter of 0.60 μm in circle equivalent, an average thickness of 0.15 μm, an average aspect ratio of 5.2 and an average silver iodide content of 3.5 mol % accounted for 80% of all the grains as determined in terms of projected area.

Emulsions A to I were prepared in the same manner as above except that the gelatin content, pAg, ripening time and ripening temperature were altered.

A multi-layer color photographic material was prepared as Specimen 101 by applying various layers having the following compositions to a undercoated cellulose triacetate film support.

(Composition of light-sensitive layers)

The coated amount of silver halide and colloidal silver is represented in g/m$^2$ as calculated in terms of silver. The coated amount of coupler, additive and gelatin is represented in g/m$^2$. The coated amount of sensitizing dye is represented in the number of moles per mole of silver halide in the same layer. The symbols indicating additives have the following meanings. However, additives having a plurality of effects were represented by one of the effects. UV: ultraviolet absorbent; Solv: high boiling organic solvent; ExF: dye; ExS: sensitizing dye; ExC: cyan coupler; ExM: magenta coupler; ExY: yellow coupler; Cpd: additive

| 1st layer: antihalation layer | |
|---|---|
| Black colloidal silver | 0.15 |
| Gelatin | 2.33 |
| UV-1 | $3.0 \times 10^{-2}$ |
| UV-2 | $6.0 \times 10^{-2}$ |
| UV-3 | $7.0 \times 10^{-2}$ |
| ExF-1 | $1.0 \times 10^{-2}$ |
| ExF-2 | $4.0 \times 10^{-2}$ |
| ExF-3 | $5.0 \times 10^{-3}$ |
| ExM-3 | 0.11 |
| Cpd-5 | $1.0 \times 10^{-3}$ |
| Solv-1 | 0.16 |
| Solv-2 | 0.10 |
| **2nd layer: low sensitivity red-sensitive emulsion layer** | |
| Silver bromoiodide emulsion A | 0.35 (as silver) |
| Silver bromoiodide emulsion B | 0.18 (as silver) |
| Gelatin | 0.77 |
| ExS-1 | $6.5 \times 10^{-4}$ |
| ExS-2 | $3.6 \times 10^{-4}$ |
| ExS-5 | $6.2 \times 10^{-4}$ |
| ExS-7 | $4.1 \times 10^{-6}$ |
| ExC-1 | $9.0 \times 10^{-2}$ |

| | |
|---|---|
| ExC-2 | $5.0 \times 10^{-3}$ |
| ExC-3 | $4.0 \times 10^{-2}$ |
| ExC-5 | $8.0 \times 10^{-2}$ |
| ExC-6 | $2.0 \times 10^{-2}$ |
| ExC-9 | $2.5 \times 10^{-2}$ |
| Cpd-1 | $2.2 \times 10^{-2}$ |
| 3rd layer: middle sensitivity red-sensitive emulsion layer | |
| Silver bromoiodide emulsion C | 0.55 (as silver) |
| Gelatin | 1.46 |
| ExS-1 | $4.3 \times 10^{-4}$ |
| ExS-2 | $2.4 \times 10^{-4}$ |
| ExS-5 | $4.1 \times 10^{-4}$ |
| ExS-7 | $4.3 \times 10^{-6}$ |
| ExC-1 | 0.19 |
| ExC-2 | $1.0 \times 10^{-2}$ |
| ExC-3 | $1.0 \times 10^{-2}$ |
| ExC-4 | $1.6 \times 10^{-2}$ |
| ExC-5 | 0.19 |
| ExC-6 | $2.0 \times 10^{-2}$ |
| ExC-7 | $2.5 \times 10^{-2}$ |
| ExC-9 | $3.0 \times 10^{-2}$ |
| Cpd-4 | $1.5 \times 10^{-2}$ |
| 4th layer: high sensitivity red-sensitive emulsion layer | |
| Silver bromoiodide emulsion D | 1.05 (as silver) |
| Gelatin | 1.38 |
| ExS-1 | $3.6 \times 10^{-4}$ |
| ExS-2 | $2.0 \times 10^{-4}$ |
| ExS-5 | $3.4 \times 10^{-4}$ |
| ExS-7 | $1.4 \times 10^{-5}$ |
| ExC-1 | $2.0 \times 10^{-2}$ |
| ExC-3 | $2.0 \times 10^{-2}$ |
| ExC-4 | $9.0 \times 10^{-2}$ |
| ExC-5 | $5.0 \times 10^{-2}$ |
| ExC-8 | $1.0 \times 10^{-2}$ |
| ExC-9 | $1.0 \times 10^{-2}$ |
| Cpd-4 | $1.0 \times 10^{-3}$ |
| Solv-1 | 0.70 |
| Solv-2 | 0.15 |
| 5th layer: interlayer | |
| Gelatin | 0.62 |
| Cpd-1 | 0.13 |
| Polyethyl acrylate latex | $8.0 \times 10^{-2}$ |
| Solv-1 | $8.0 \times 10^{-2}$ |
| 6th layer: low sensitivity green-sensitive emulsion layer | |
| Silver bromoiodide emulsion A | 0.28 (as silver) |
| Silver bromoiodide emulsion B | 0.10 (as silver) |
| Gelatin | 0.31 |
| ExS-4 | $12.8 \times 10^{-4}$ |
| ExS-5 | $2.1 \times 10^{-4}$ |
| ExS-8 | $1.2 \times 10^{-4}$ |
| ExM-1 | 0.12 |
| ExM-7 | $2.1 \times 10^{-2}$ |
| Solv-1 | 0.09 |
| Solv-3 | $7.0 \times 10^{-3}$ |
| 7th layer: middle sensitivity green-sensitive emulsion layer | |
| Silver bromoiodide emulsion C | 0.25 (as silver) |
| Gelatin | 0.54 |
| ExS-4 | $8.5 \times 10^{-4}$ |
| ExS-5 | $1.4 \times 10^{-4}$ |
| ExS-8 | $8.3 \times 10^{-5}$ |
| ExM-1 | 0.27 |
| ExM-7 | $7.2 \times 10^{-2}$ |
| ExY-1 | $5.4 \times 10^{-2}$ |
| Solv-1 | 0.23 |
| Solv-3 | $1.8 \times 10^{-2}$ |
| 8th layer: high sensitivity green-sensitive emulsion layer | |
| Silver bromoiodide emulsion D | 0.53 (as silver) |
| Gelatin | 0.61 |
| ExS-4 | $7.1 \times 10^{-4}$ |

| | |
|---|---|
| ExS-5 | $1.4 \times 10^{-4}$ |
| ExS-8 | $4.6 \times 10^{-5}$ |
| ExM-2 | $5.5 \times 10^{-3}$ |
| ExM-3 | $1.0 \times 10^{-2}$ |
| ExM-5 | $1.0 \times 10^{-2}$ |
| ExM-6 | $3.0 \times 10^{-2}$ |
| ExY-1 | $1.0 \times 10^{-2}$ |
| ExC-1 | $4.0 \times 10^{-3}$ |
| ExC-4 | $2.5 \times 10^{-3}$ |
| Cpd-6 | $1.0 \times 10^{-2}$ |
| Solv-1 | 0.12 |
| 9th layer: interlayer | |
| Gelatin | 0.56 |
| UV-4 | $4.0 \times 10^{-2}$ |
| UV-5 | $3.0 \times 10^{-2}$ |
| Cpd-1 | $4.0 \times 10^{-2}$ |
| Polyethyl acrylate latex | $5.0 \times 10^{-2}$ |
| Solv-1 | $3.0 \times 10^{-2}$ |
| 10th layer: donor layer having an interlayer effect on red-sensitive layer | |
| Silver bromoiodide emulsion E | 0.40 (as silver) |
| Silver bromoiodide emulsion F | 0.20 (as silver) |
| Silver bromoiodide emulsion G | 0.39 (as silver) |
| Gelatin | 0.87 |
| ExS-3 | $9.8 \times 10^{-4}$ |
| ExM-2 | 0.16 |
| ExM-4 | $3.0 \times 10^{-2}$ |
| ExM-5 | $5.0 \times 10^{-2}$ |
| ExY-2 | $2.5 \times 10^{-3}$ |
| ExY-5 | $2.0 \times 10^{-2}$ |
| Solv-1 | 0.30 |
| Solv-5 | $3.0 \times 10^{-2}$ |
| 11th layer: yellow filter layer | |
| Yellow colloidal silver | $4.2 \times 10^{-2}$ |
| DYE-1 | $1.02 \times 10^{-1}$ |
| Gelatin | 0.84 |
| Cpd-1 | $5.0 \times 10^{-2}$ |
| Cpd-2 | $5.0 \times 10^{-2}$ |
| Cpd-5 | $2.0 \times 10^{-3}$ |
| Solv-1 | 0.13 |
| H-1 | 0.25 |
| 12th layer: low sensitivity blue-sensitive emulsion layer | |
| Silver bromoiodide emulsion A | 0.50 (as silver) |
| Silver bromoiodide emulsion H | 0.40 (as silver) |
| Gelatin | 1.75 |
| ExS-6 | $9.0 \times 10^{-4}$ |
| ExY-1 | $8.5 \times 10^{-2}$ |
| ExY-2 | $5.5 \times 10^{-3}$ |
| ExY-3 | $6.0 \times 10^{-2}$ |
| ExY-5 | 1.00 |
| ExC-1 | $5.0 \times 10^{-2}$ |
| ExC-2 | $8.0 \times 10^{-2}$ |
| Solv-1 | 0.54 |
| 13th layer: interlayer | |
| Gelatin | 0.30 |
| ExY-1 | 0.14 |
| Solv-1 | 0.14 |
| 14th layer: high sensitivity blue-sensitive emulsion layer | |
| Silver bromoiodide emulsion I | 0.40 (as silver) |
| Gelatin | 0.95 |
| ExS-6 | $6.3 \times 10^{-4}$ |
| ExY-2 | $1.0 \times 10^{-2}$ |
| ExY-3 | $2.0 \times 10^{-2}$ |
| ExY-5 | 0.18 |
| ExC-1 | $1.0 \times 10^{-2}$ |
| Solv-1 | $9.0 \times 10^{-2}$ |
| 15th layer: 1st protective layer | |
| Fine silver bromoiodide emulsion J | 0.12 (as silver) |
| Gelatin | 0.63 |
| UV-4 | 0.11 |
| UV-5 | 0.18 |

-continued

| | |
|---|---|
| Cpd-3 | 0.10 |
| Solv-1 | $2.0 \times 10^{-2}$ |
| Polyethyl acrylate latex | $9.0 \times 10^{-2}$ |
| 16th layer: 2nd protective layer | |
| Fine silver bromoiodide emulsion J | 0.36 (as silver) |
| Gelatin | 0.85 |
| B-1 (diameter: 2.0 μm) | $8.0 \times 10^{-2}$ |
| B-2 (diameter: 2.0 μm) | $8.0 \times 10^{-2}$ |
| B-3 | $2.0 \times 10^{-2}$ |
| W-5 | $2.0 \times 10^{-2}$ |
| H-1 | 0.18 |

Besides these components, 1,2-benzisothiazoline-3-one (in an average amount of 200 ppm based on the amount of gelatin), n-butyl-p-hydroxybenzoate (in an average amount of about 1,000 ppm), and 2-phenoxyethanol (in an average amount of about 10,000 ppm) were added to the specimens thus prepared. In order to improve the preservability, processability, pressure resistance, mildew resistance, bacteria resistance, antistatic properties, and coating properties of the material, W-1 to W-6, B-1 to B-6, F-1 to F-16, iron salt, lead salt, gold salt, platinum salt, iridium salt, and rhodium salt were properly incorporated in the various layers.

TABLE 1

| Emulsion | Average AgI content (%) | Average grain diameter in sphere equivalent | Grain Diameter distribution fluctuation coefficient (%) | Diameter/ thickness ratio | Grain form |
|---|---|---|---|---|---|
| Emulsion A | 3.0 | 0.28 | 23 | 4.5 | Tabular |
| B | 3.0 | 0.35 | 25 | 5.6 | " |
| C | 8.8 | 0.53 | 22 | 5.5 | " |
| D | 8.8 | 0.67 | 26 | 6.0 | " |
| E | 2.5 | 0.28 | 21 | 4.8 | " |
| F | 3.5 | 0.60 | 23 | 5.2 | " |
| G | 3.4 | 0.53 | 25 | 5.8 | " |
| H | 8.8 | 0.62 | 26 | 6.0 | " |
| I | 8.8 | 0.75 | 26 | 6.5 | " |
| J | 2.0 | 0.07 | 15 | 1.0 | Uniformly structured, finely divided |

In Table 1, (1) Emulsions A to I were subjected to reduction sensitization with thiourea dioxide and thiosulfonic acid in accordance with an example in JP-A-2-191938 (corresponding to U.S. Pat. No. 5,061,614);

(2) The preparation of tabular grains was conducted with the use of a low molecular gelatin in accordance with JP-A-1-158426; and (3) The tabular grains were observed under a high voltage electron microscope to exhibit a transition line as described in JP-A-3-237450 (corresponding to EP-A-443453).

(4) Emulsions A to I comprised iridium incorporated in the grains in accordance with the method as described in B. H. Carroll, "Photographic Science and Engineering", 24, 265 (1980).

UV-1
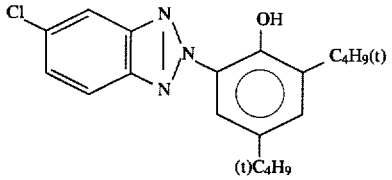
UV-2
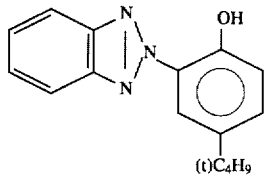
UV-3
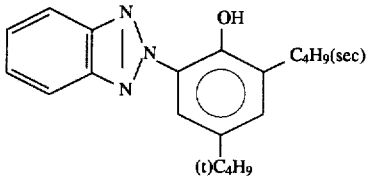
UV-4
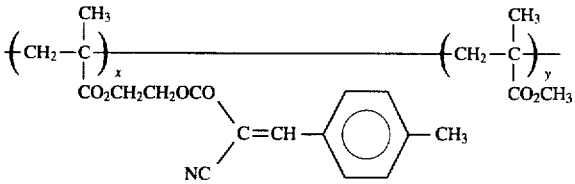
x:y = 70:30 (wt %)
UV-5
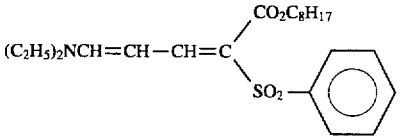
ExF-1
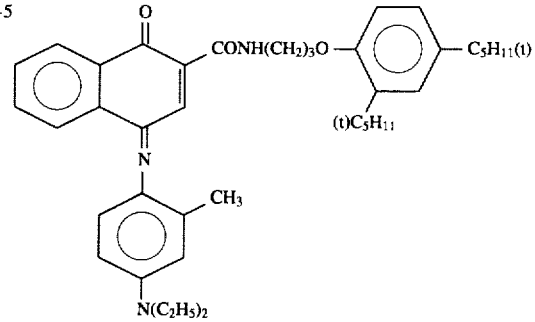
ExF-2
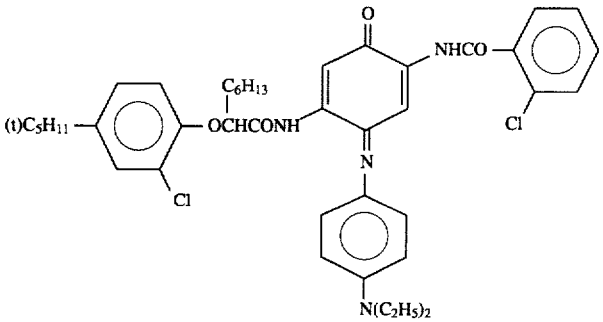
ExF-3
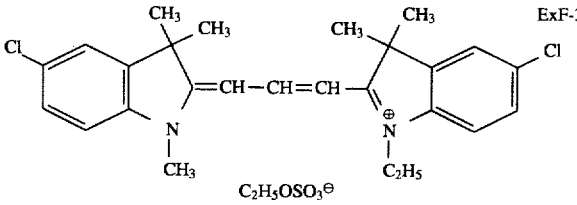
ExC-1
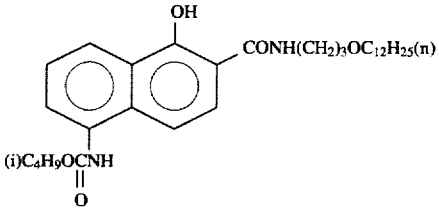

-continued
ExC-2
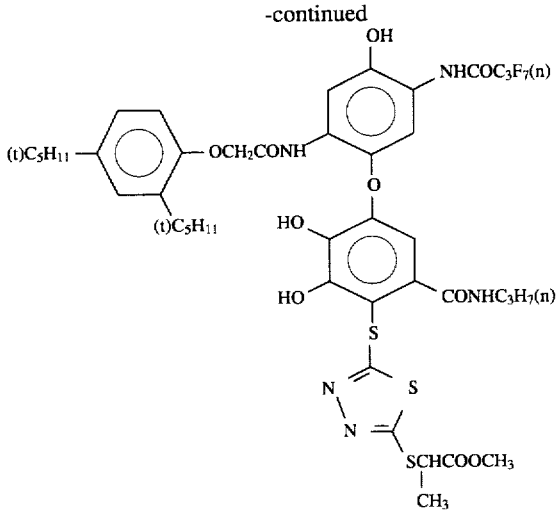
ExC-3
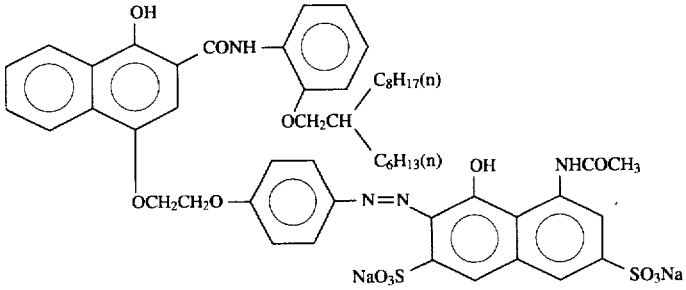
ExC-4
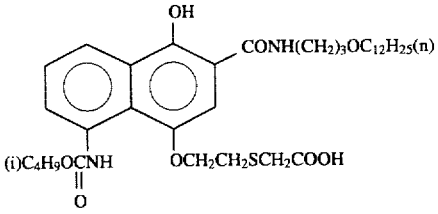
ExC-5
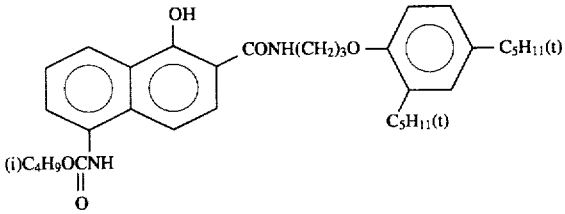
ExC-6
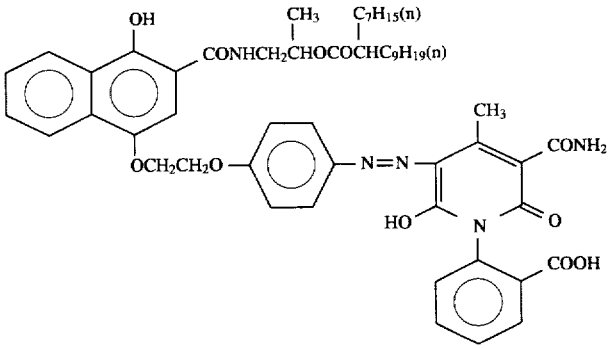

-continued
ExC-7
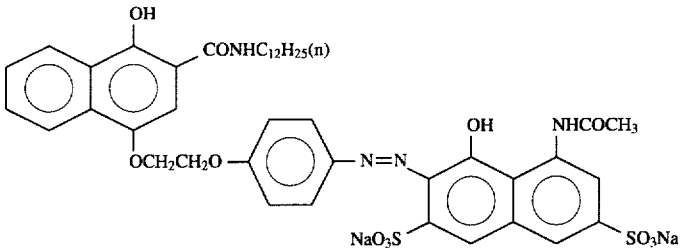
ExC-8
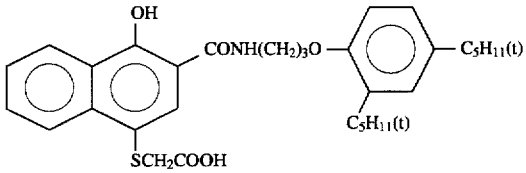
ExC-9
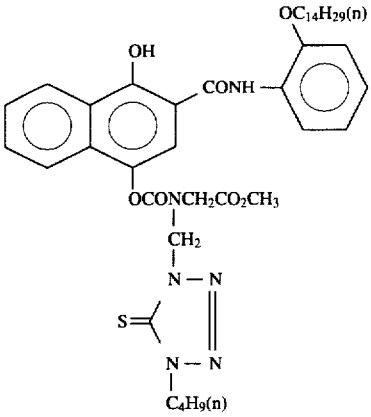
ExM-1
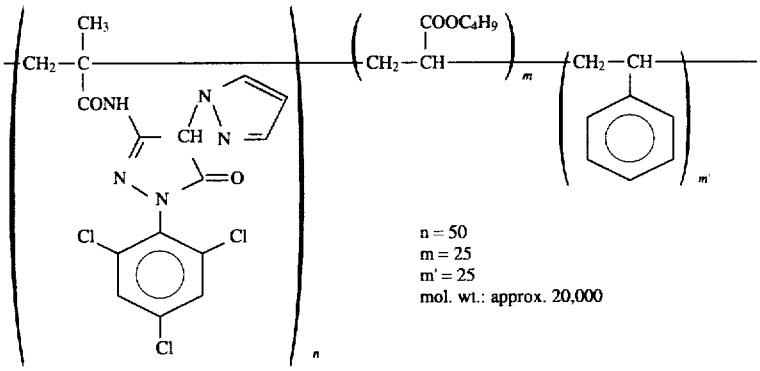
ExM-2
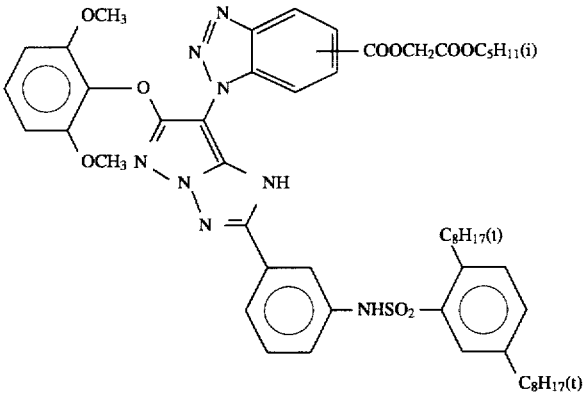

-continued
ExM-3
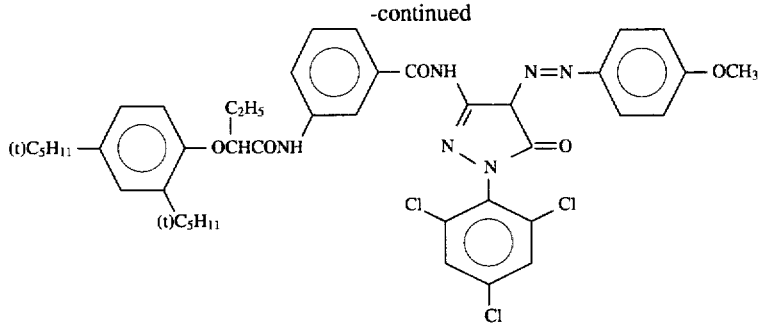
ExM-4
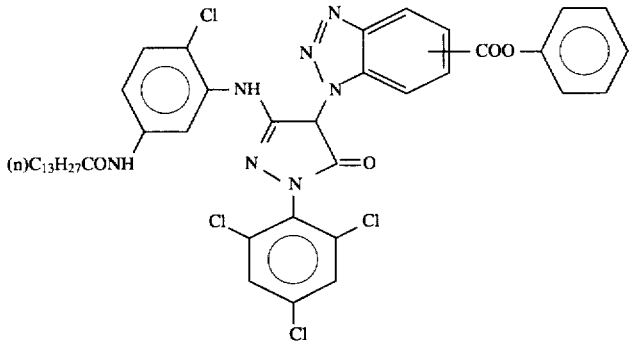
ExM-5
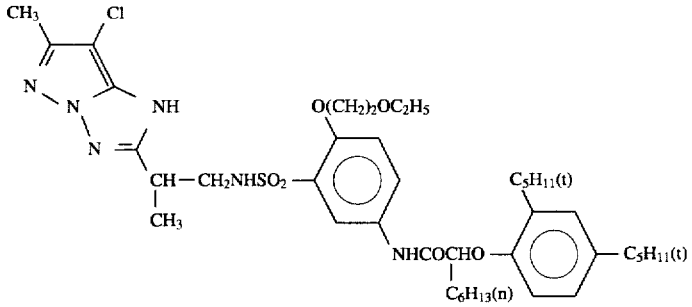
ExM-6
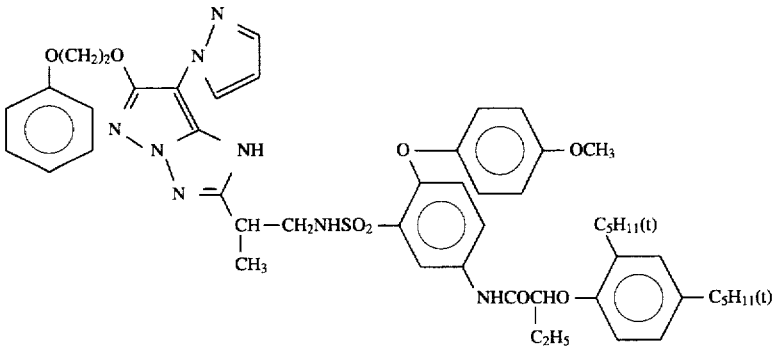
ExM-7
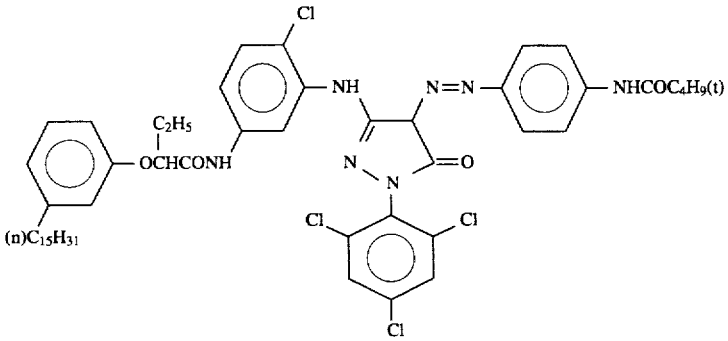

-continued
ExY-1
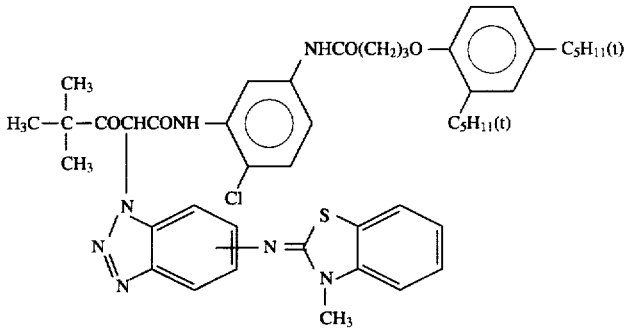
ExY-2
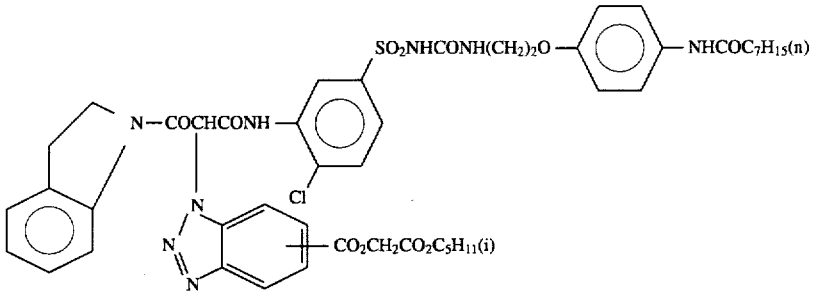
ExY-3
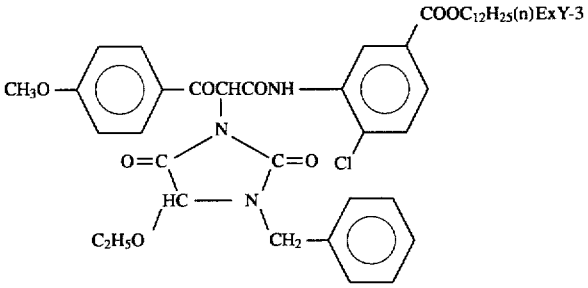
ExY-5
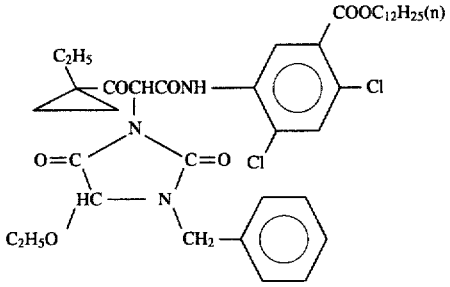
Cpd-1
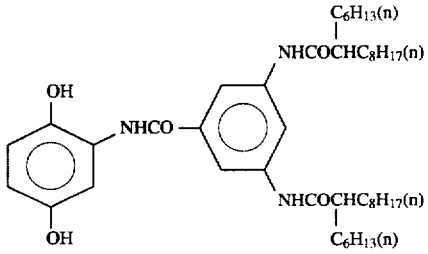
Cpd-2
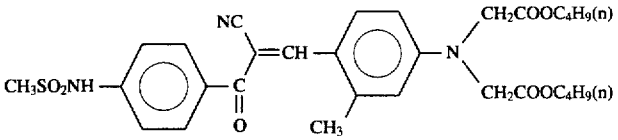
Cpd-3
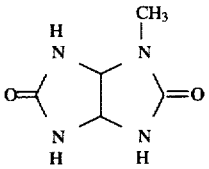
Cpd-4
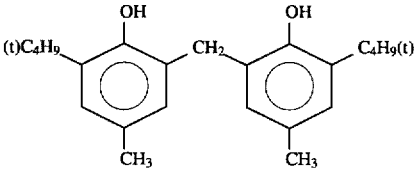

-continued
Cpd-5
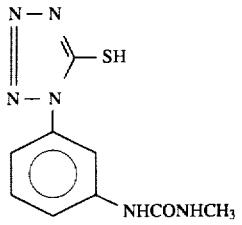
Cpd-6
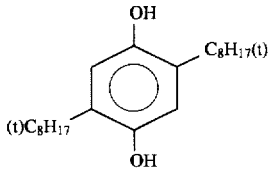
Solv-1
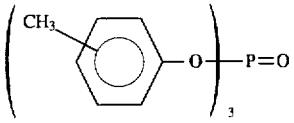
Solv-2
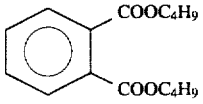
Solv-3
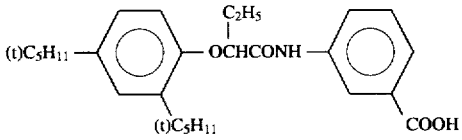
Solv-5
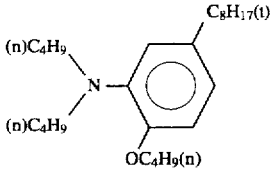
ExS-1
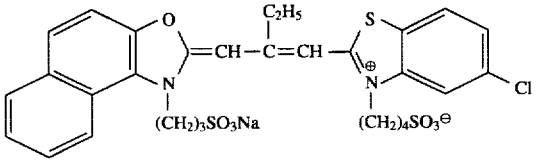
ExS-2
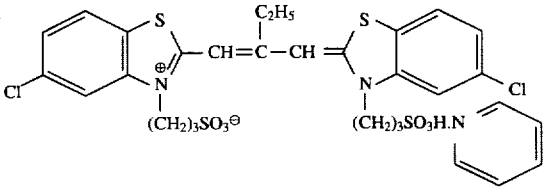
ExS-3
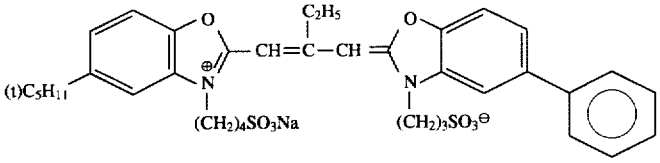
ExS-4
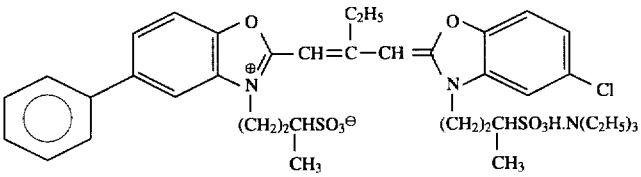
ExS-5
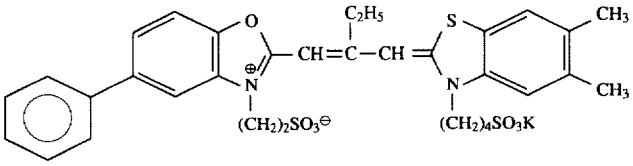
ExS-6
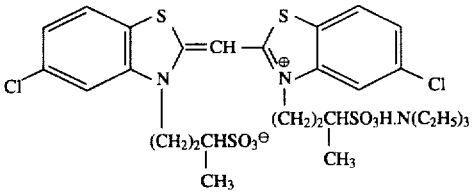
ExS-7
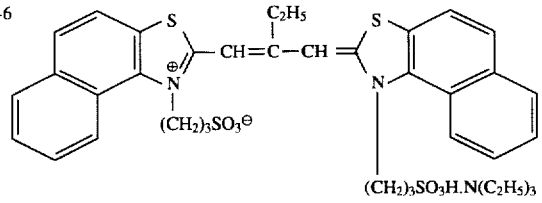
ExS-8
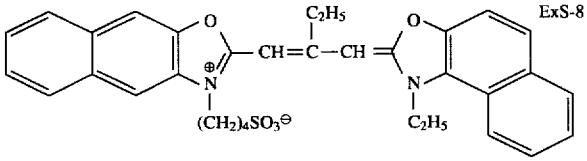
H-1
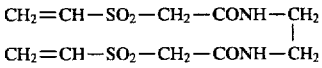

-continued
W-1
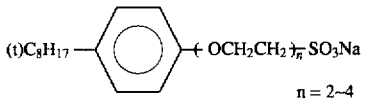
W-2
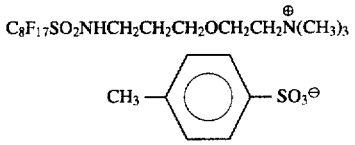
W-3
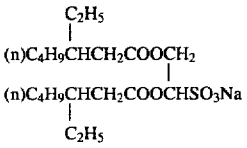
W-4
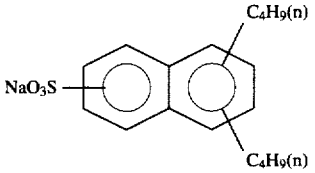
W-5
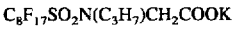
W-6
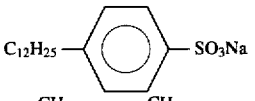
B-1
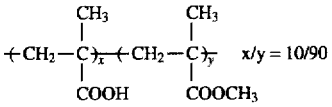
B-2
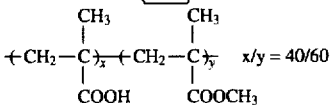
B-3
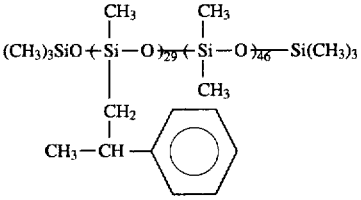
B-4
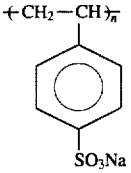
B-5
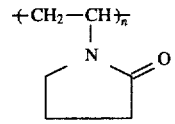
(mol. wt. approx. 10,000)
B-6
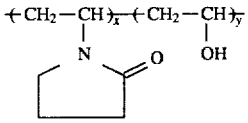
F-1
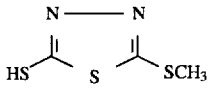
F-2
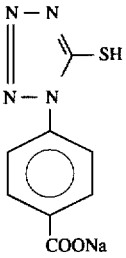
F-3
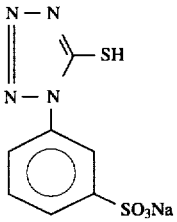
F-4
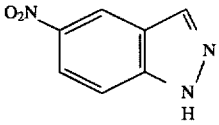
F-5
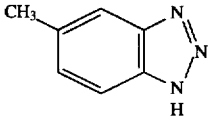
F-6
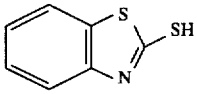

-continued

F-7

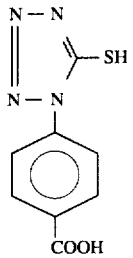

F-8

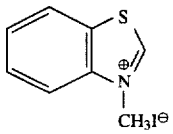

F-9

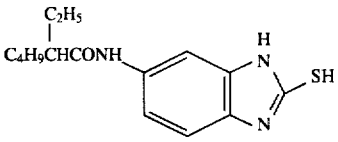

F-10

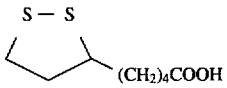

F-11

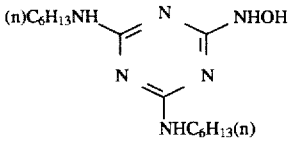

F-12

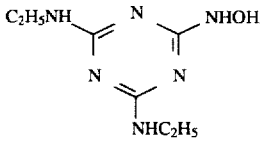

F-13

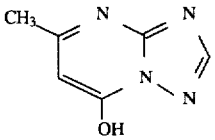

F-14

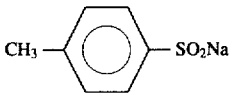

F-15

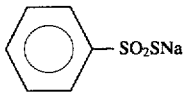

F-16

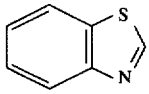

DYE-1

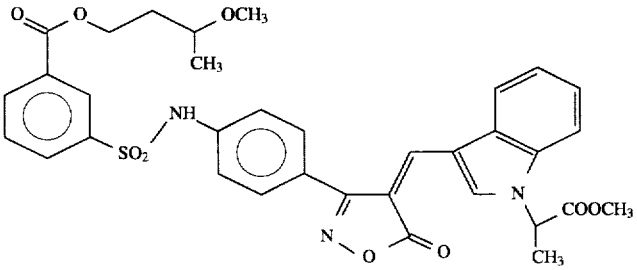

(Preparation of Specimens 102 to 114)

Specimens 102 to 114 were prepared in the same manner as Specimen 101 except that the sensitizing dye (ExS-3) and the coupler (ExM-2) to be incorporated in the 10th layer were replaced by those set forth in Table 2 and a fine adjustment was conducted to obtain a proper gray balance.

TABLE 2

| No. | Sensitizing dye in 10th layer (mixing ratio) | Main coupler in 10th layer | Discrimination of various green colors (*A) | Storage fog of magenta | Desensitization of yellow during storage |
|---|---|---|---|---|---|
| 101 | ExS-3 | ExM-2 (=II-4) | 3.3 | 0.15 | −0.02 |
| 102 | " | ExM-8 | 3.3 | 0.15 | −0.03 |
| 103 | I-4 | ExY-6 | 3.5 | 0.10 | −0.02 |
| 104 | " | ExM-8 | 3.5 | 0.10 | −0.03 |
| 105 | ExS-9 | ExY-6 | 3.2 | 0.17 | −0.02 |
| 106 | I-4 | ExM-2(=II-4) | 4.0 | 0.07 | −0.02 |
| 107 | I-18 | " | 4.2 | 0.06 | −0.02 |
| 108 | I-34 | " | 4.0 | 0.06 | −0.02 |
| 109 | ExS-10 | " | 3.8 | 0.06 | −0.15 |

TABLE 2-continued

| No. | Sensitizing dye in 10th layer (mixing ratio) | Main coupler in 10th layer | Discrimination of various green colors (*A) | Storage fog of magenta | Desensitization of yellow during storage |
|---|---|---|---|---|---|
| 110 | I-18/III-3 (75/25) | " | 4.5 | 0.07 | −0.02 |
| 111 | I-18/III-23 (75/25) | " | 4.5 | 0.09 | −0.02 |
| 112 | I-18/III-8 (75/25) | " | 4.2 | 0.06 | −0.02 |
| 113 | I-18/III-14 (80/20) | " | 4.2 | 0.07 | −0.02 |
| 114 | I-18/III-3 (75/25) | II−16 | 4.5 | 0.07 | −0.02 |
| 115 | I-18/III-3 (50/50) | ExM-2(=II-14) | 3.2 | 0.09 | −0.02 |
| 116 | I-18/III-3 (40/60) | " | 2.5 | 0.13 | −0.02 |
| 117 | I-4/III-2 (40/60) | ExM-8 | 2.5 | 0.13 | −0.02 |

(Specimens 101 to 105, 109, 116, and 117 are comparative while the others are according to the present invention)
*A 5 . . . Very excellent
4 . . . Excellent
3 . . . Fair
2 . . . Poor
1 . . . Very poor

30

ExS-9

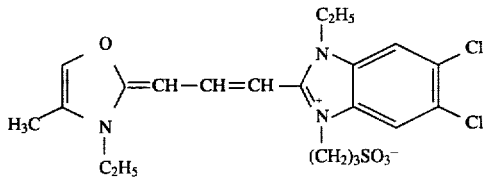

ExY-6

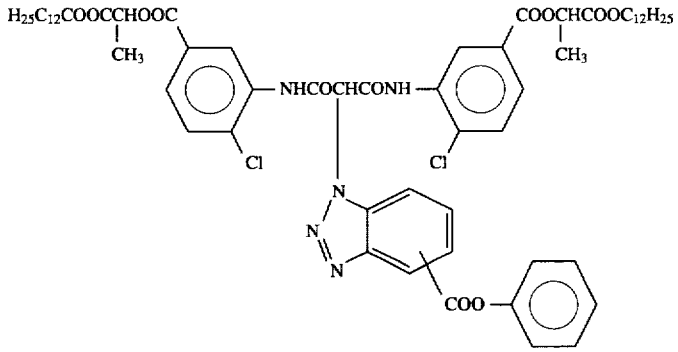

-continued

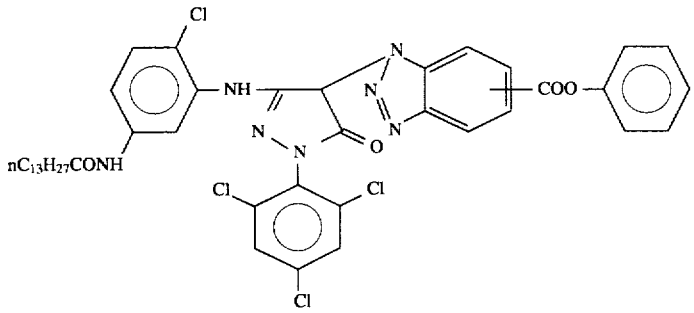

ExM-8

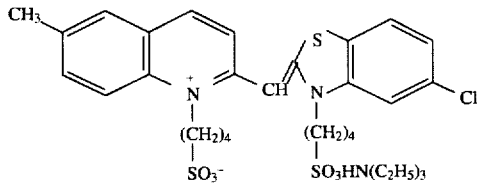

ExS-10

Evaluation values given by 10 evaluators were averaged.

(Evaluation of preservability)

The specimen was stored at a temperature of 40° C. and a relative humidity of 60% for 30 days, subjected to development in accordance with the method as described later, and then measured for magenta density. The change in magenta density between before and after storage was determined.

On the other hand, the specimen was stored at a temperature of 50° C. and a relative humidity of 80% for 3 days, subjected to continuous wedgewise exposure to white light, subjected to development in accordance with the method as described later, and then examined for the (logarithm) change in the reciprocal of the exposure giving a yellow density of 2.0.

(Evaluation of color reproducibility)

In the same manner as in Example 1 of JP-A-61-34541, a color chart having various green colors with a peak wavelength of 470 to 580 nm and a gray chart was photographed on the specimen at the same time. The image was the printed on a Fuji color paper in such a manner that the gray chart was reproduced. The discrimination of the various green colors was organoleptically evaluated by 10 evaluators.

(Development method)

| Step | Processing time | Processing temperature | Replenishment rate* | Tank Capacity |
|---|---|---|---|---|
| Color development | 3 min. 15 sec. | 38° C. | 45 ml | 10 l |
| Bleach | 1 min. 00 sec. | 38° C. | 20 ml | 4 l |
| Blix | 3 min. 15 sec. | 38° C. | 30 ml | 8 l |
| Rinse (1) | 40 sec. | 35° C. | ** | 4 l |
| Rinse (2) | 1 min. 00 sec. | 35° C. | 30 ml | 4 l |
| Stabilization | 40 sec. | 38° C. | 20 ml | 4 l |
| Drying | 1 min. 15 sec. | 55° C. | | |

*Replenishment rate: per 1-m long 35-mm wide specimen

**Countercurrent process in which the washing water flows backward

The various processing solution had the following compositions:

Color developer

| | Running solution(g) | Replenisher(g) |
|---|---|---|
| Diethylenetriamine-pentaacetic acid | 1.0 | 1.1 |
| 1-Hydroxyethylidene-1,1-diphosphonic acid | 3.0 | 3.2 |
| Sodium sulfite | 4.0 | 4.4 |
| Potassium carbonate | 30.0 | 37.0 |
| Potassium bromide | 1.4 | 0.7 |
| Potassium iodide | 1.5 mg | — |
| Hydroxylamine sulfate | 2.4 | 2.8 |
| 4-(N-ethyl-N-β-hydroxyethylamino)-2-methylaniline sulfate | 4.5 | 5.5 |
| Water to make | 1.0 l | 1.0 l |
| pH | 10.05 | 10.10 |

Bleaching agent

| | Common to both running solution and replenisher (g) |
|---|---|
| Ammonium ethylenediamine-tetraacetato ferrate dihydrate | 120.0 |
| Disodium ethylenediaminetetraacetate | 10.0 |
| Ammonium bromide | 100.0 |
| Ammonium nitrate | 10.0 |
| Bleach accelerator $\{(CH_3)_2N—CH_2CH_2—S\}_2.2HCl$ | 0.005 mol |
| 27% Aqueous ammonia | 15.0 ml |
| Water to make | 1.0 l |
| pH | 6.3 |

Blix solution

| | Common to both running solution and replenisher (g) |
|---|---|
| Ammonium ethylenediamine-tetraacetato ferrate dihydrate | 50.0 |
| Disodium ethylenediaminetetraacetate | 5.0 |
| Sodium sulfite | 12.0 |
| 70% Aqueous solution of ammonium thiosulfate | 240.0 ml |
| 27% Aqueous ammonia | 6.0 ml |
| Water to make | 1.0 l |

-continued

| | |
|---|---|
| pH | 7.2 |

Rinsing solution
Common to both running solution and replenisher

Tap water was passed through a mixed bed column filled with an H type strongly acidic cation exchange resin (Amberlite IR-120B produced by Rohm & Haas) and an OH type anion exchange resin (Amberlite IR-400 produced by Rohm & Haas) so that the calcium and magnesium ion concentrations were each reduced to 3 mg/l or less. To the solution were then added 20 mg/l of dechlorinated sodium isocyanurate and mg/l of sodium sulfate. The pH range of the solution was from 6.5 to 7.5.

Stabilizing solution

| | Common to both running solution and replenisher |
|---|---|
| 37% Formalin | 2.0 ml |
| Polyoxyethylene-p-monononyl-phenylether (average polymerization degree: 10) | 0.3 |
| Disodium ethylenediaminetetraacetate | 0.05 |
| Water to make | 1.0 l |

The combined use of the compounds (I) and (II) of the present invention or the compounds (I), (II) and (III) of the present invention can provide improvement in the discrimination of green colors and reduction in the generation of storage fog of magenta and the desensitization of yellow during storage.

It was also found that the replacement of the compound (I) of the present invention (simple oxaquinoline) by ExS-10 (simple thiaquinoline) provides an unexpected side effect of yellow desensitization during storage.

EXAMPLE 2

The same specimens as prepared in Example 1 were each subjected to heat treatment, and then applied to a 85-μm thick PEN [2,6-naphthalenedicarboxylic acid/ethylene glycol (molar ratio: 100/100) support which had been coated with a ferromagnetic substance for magnetic recording on its back surface in an amount such that a yellow density of 0.12 was attained. These specimens were then tested for preservability, color reproducibility and pressure properties. Results similar to that of Example 1 were obtained.

EXAMPLE 3

Emulsions were prepared in the same manner as in Example 1 except that the sensitizing dye was added between after the formation of grains and before the chemical sensitization to effect chemical sensitization. The compounds (I) and (III) were added at the same time. The emulsions thus obtained were each then applied to a support in the same manner as in Example 1. The specimens were then evaluated in the same manner as in Example 1. Similarly to Example 1, the light-sensitive materials comprising compounds of the present invention exhibited a good color reproducibility and preservability.

EXAMPLE 4

(Preparation of Emulsion K (cubic seed emulsion))

To 1.5 l of an aqueous solution containing 0.2 g/l of potassium bromide and 25 g/l of gelatin were added a 0.94 mol/l aqueous solution of silver nitrate and a 0.94 mol/l aqueous solution of potassium bromide by double jet process at a temperature of 45° C. while the pAg value thereof was being kept to 7.3. Thus, Emulsion K comprising cubic silver bromide grains having a diameter of 0.22 μm in sphere equivalent was prepared.

(Preparation of Emulsion L)

To the seed emulsion K were added a 0.94 mol/l aqueous solution of silver nitrate and a 0.94 mol/l aqueous solution of potassium halide (Br: 97%; I: 3%) by double jet process at a temperature of 70° C. while the pAg value thereof was being kept to 7.3. Thus, cubic silver bromoiodide grains having a diameter of 0.33 μm in sphere equivalent with a variation coefficient of 11% were obtained. The emulsion was then rinsed by an ordinary method. The emulsion was then subjected to optimum post-ripening with sodium thiosulfate, potassium thiocyanate and dimethylselenourea chloroaurate.

(Preparation of Emulsion M)

An emulsion of cubic silver bromoiodide grains having a diameter of 0.60 μm was prepared in the same manner as Emulsion L.

(Preparation of Specimen 301)

Specimen 301 was prepared in the same manner as Specimen 101 except that Emulsions E, F and G to be incorporated in the 10th layer were replaced by Emulsion L (0.40 g/m$^2$ as silver) and Emulsion M (0.45 g/m$^2$ as silver). The amount of the sensitizing dye was $4.2\times10^{-4}$ mol/mol Ag.

(Preparation of Specimens 302 to 307)

Specimens 302 to 307 were prepared in the same manner as Specimen 301 except that the sensitizing dye ExS-3 and the coupler ExM-2 in the 10th layer were replaced by those set forth in Table 4.

Specimens 301 to 307 thus prepared were then evaluated for color reproducibility and preservability in the same manner as in Example 1.

TABLE 3

| No. | Sensitizing dye in 10th layer (mixing ratio) | Main coupler in 10th layer | Discrimination of various green colors (*A) | Storage fog of magenta | Desensitization of yellow during storage |
|---|---|---|---|---|---|
| 301 | ExS-3 | ExM-2 (=I-4) | 3.5 | 0.13 | −0.02 |
| 302 | ExS-9 | ExY-6 | 3.4 | 0.15 | −0.03 |
| 303 | I-17 | " | 3.8 | 0.10 | −0.02 |
| 304 | I-17 | ExM-2 (I-14) | 4.3 | 0.05 | −0.02 |
| 305 | I-18 | " | 4.3 | 0.05 | −0.02 |

TABLE 3-continued

| No. | Sensitizing dye in 10th layer (mixing ratio) | Main coupler in 10th layer | Discrimination of various green colors (*A) | Storage fog of magenta | Desensitization of yellow during storage |
|---|---|---|---|---|---|
| 306 | I-18/III-3 (75/25) | " | 4.6 | 0.06 | −0.02 |
| 307 | ExS-10/III-3 (75/25) | " | 4.2 | 0.06 | −0.16 |

(Specimens 301 to 303 and 307 are comparative while the others are according to the present invention)
*A: same as in Example 1

As mentioned above, the use of compounds of the present invention can provide a silver halide color photographic material having an excellent color reproducibility and preservability.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising a support having provided thereon at least one blue-sensitive silver halide emulsion layer containing a yellow color coupler, at least one green-sensitive silver halide emulsion layer containing a magenta color coupler, at least one red-sensitive silver halide emulsion layer containing a cyan color coupler, and at least one silver halide emulsion layer which is a further layer and which provides said at least one red-sensitive silver halide emulsion layer with an interlayer effect, wherein said at least one silver halide emulsion layer which provides an interlayer effect is spectrally sensitized with a sensitizing dye represented by the following formula (I) and comprises a development inhibitor-releasing compound represented by the following formula (II):

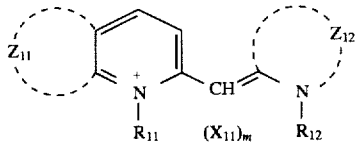

(I)

wherein $R_{11}$ and $R_{12}$ each represents an alkyl group; $Z_{11}$ represents an atomic group necessary for the formation of benzene ring; $Z_{12}$ represents an atomic group necessary for the formation of benzooxazole nucleus; $X_{11}$ represents a charge-balanced paired ion; and m represents 0 or 1, with the proviso that when the sensitizing dye forms an intramolecular salt, m is 0;

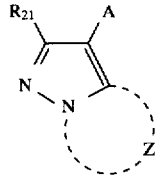

(II)

wherein $R_{21}$ represents a hydrogen atom or substituent; Z represents a nonmetallic atom group necessary for the formation of a 5-membered azole ring containing 2 to 4 nitrogen atoms which may have substituents; and A represents a group which undergoes coupling reaction with the oxidation product of a developing agent to release itself to give a development inhibitor or precursor thereof or a group which undergoes coupling reaction with the oxidation product of a developing agent to release itself and then undergoes reaction with another molecule of the oxidation product of a developing agent to give a development inhibitor or precursor thereof.

2. The silver halide color photographic material according to claim 1, wherein said at least one layer which provides said at least one red-sensitive silver halide emulsion layer with an interlayer effect contains a sensitizing dye represented by the following formula (III) in an amount of not more than 50 mol % based on the amount of said compound represented by the formula (I):

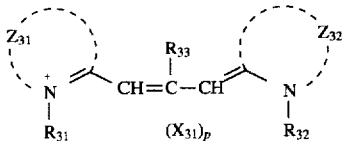

(III)

wherein $R_{31}$ and $R_{32}$ have the same meaning as $R_{11}$ and $R_{12}$ in the formula (I), respectively; $R_{33}$ represents a hydrogen atom, alkyl group or aryl group; $Z_{31}$ and $Z_{32}$ are the same or different and each represents an atomic group necessary for the formation of a 5- or 6-membered nitrogen-containing heterocyclic group; and $X_{31}$ and p have the same meaning as $X_{11}$ and m in the formula (I).

3. The silver halide color photographic material according to claim 1, wherein the compound of formula (II) is represented by formula (P-1), (P-2), (P-3) or (P-4) as follows:

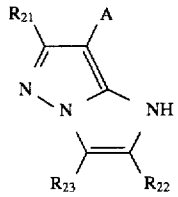

(P-1)

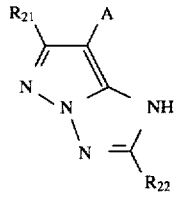

(P-2)

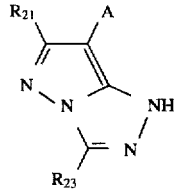

(P-3)

-continued

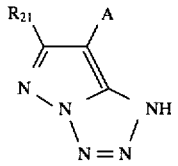

(P-4)

wherein $R_{21}$, $R_{22}$ and $R_{23}$ represent a hydrogen atom, a halogen atom, an alkyl group, an aryl group, a heterocyclic group, a cyano group, a hydroxyl group, a nitro group, a carboxyl group, an amino group, an alkoxy group, an aryloxy group, an acylamino group, an alkylamino group, an anilino group, a ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, a heterocyclic oxy group, an azo group, an acyloxy group, a carbamoyloxy group, a silyloxy group, an aryloxycarbonylamino group, an imido group, a heterocyclic thio group, a sulfinyl group, a phosphonyl group, an aryloxycarbonyl group, an acyl group, or an azolyl group; and A represents the following formula (A-1):

$$-\{(L_1)_a-(B)_m\}_p-(L_2)_n-DI \quad \text{(A-1)}$$

wherein $L_1$ represents a group which causes cleavage of the bond in formula (A-1) between $L_1$ and $(B)_m$) after the cleavage of the bond between (A-1) and the carbon atom to which A is bonded; B represents a group which reacts with the oxidation product of a developing agent to cause cleavage of the bond in formula (A-1) between $\{(L_1)_a-(B_m)\}_n$; $L_2$ represents a group which causes the cleavage of the bond in formula (A-1) between $L_2$ and DI after cleavage of the bond in formula (A-1) between $(L_2)_n$ and $\{(L_1)_a-(B_m)\}_p$; DI represents a development inhibitor; a, m and n each represents 0 or 1; and p represents 0, 1 or 2, with the proviso that when p is plural, the plurality of $\{(L_1)_a$31 $(B)_m\}$'s are the same or different.

4. The silver halide color photographic material according to claim 1, wherein $R_{21}$ represents a hydrogen atom, a halogen atom, an alkyl group, an aryl group, a heterocyclic group, a cyano group, a hydroxyl group, a nitro group, a carboxyl group, an amino group, an alkoxy group, an aryloxy group, an acylamino group, an alkylamino group, an anilino group, a ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, a heterocyclic oxy group, an azo group, an acyloxy group, a carbamoyloxy group, a silyloxy group, an aryloxycarbonylamino group, an imido group, a heterocyclic thio group, a sulfinyl group, a phosphonyl group, an aryloxycarbonyl group, an acyl group, or an azolyl group; wherein $R_{22}$ represents a hydrogen atom, an alkyl group, an aryl group, a heterocyclic group, an alkoxycarbonyl group, a carbamoyl group, a sulfamoyl group, a sulfinyl group, an acyl group or a cyano group; and wherein $R_{23}$ has the same meaning as $R^{21}$.

5. The silver halide color photographic material according to claim 1, wherein A represents the following formula (A-1):

$$-\{(L_1)_a-(B)_m\}_p-(L_2)_n-DI \quad \text{(A-1)}$$

wherein $L_1$ represents a group which causes cleavage of the bond in formula (A-1) between $L_1$ and $(B)_m$) after the cleavage of the leftmost bond of formula (A-1); B represents a group which reacts with the oxidation product of a developing agent to cause cleavage of the bond in formula (A-1) to the right of B; $L_2$ represents a group which causes the cleavage of the bond in formula (A-1) between $L_2$ and DI after cleavage of the bond in formula (A-1) to the left of $L_2$; DI represents a development inhibitor; a, m and n each represents 0 or 1; and p represents 0, 1 or 2, with the proviso that when p is plural, the plurality of $\{(L_1)_a-(B)_m\}$'s are the same or different.

* * * * *